US005573626A

United States Patent [19]

Rossini et al.

[11] Patent Number: 5,573,626

[45] Date of Patent: Nov. 12, 1996

[54] TAPE SUPPLY AND APPLICATOR SYSTEM INCLUDING A TAPE SPLICING MECHANISM

[75] Inventors: Steven J. Rossini, Hugo; Keith T. Pinckney, Bloomington; Karl M. Kropp, St. Paul, all of Minn.; Robert A. Luhman, Deer Park, Wis.

[73] Assignee: Minnesota Mining and Manufacturing Company, St. Paul, Minn.

[21] Appl. No.: 544,856

[22] Filed: Oct. 18, 1995

Related U.S. Application Data

[63] Continuation of Ser. No. 437,516, May 9, 1995, abandoned, which is a continuation of Ser. No. 67,240, May 26, 1993, abandoned.

[51] Int. Cl.[6] ..... B32B 31/00; B65H 26/00

[52] U.S. Cl. ..... 156/361; 156/502; 156/504; 156/495; 242/556.1

[58] Field of Search ..... 156/361, 495, 156/502, 504, 507, 517, 519; 242/555, 555.3, 556, 556.1

[56] References Cited

U.S. PATENT DOCUMENTS

| | | | |
|---|---|---|---|
| Re. 24,906 | 12/1960 | Ulrich | 206/59 |
| 2,023,147 | 12/1935 | Petsekeyes | 93/2 |
| 2,532,011 | 11/1950 | Dahlquist et al. | 154/53.5 |
| 2,972,843 | 2/1961 | Broff | 53/74 |
| 3,045,402 | 7/1962 | Keely et al. | 53/66 |
| 3,239,478 | 3/1966 | Harlan, Jr. | 260/27 |
| 3,239,994 | 3/1966 | Etzel et al. | 53/198 |
| 3,535,189 | 10/1970 | Hall et al. | 156/486 |

(List continued on next page.)

FOREIGN PATENT DOCUMENTS

| | | | |
|---|---|---|---|
| 0 502 276 | 9/1992 | European Pat. Off. | B65B 51/06 |
| 1138613 | 1/1969 | United Kingdom | G01I 1/20 |

OTHER PUBLICATIONS

*3M Handle Maker Laminator TI–1770 G–TC,* 3M Laboratories (Europe) GmbH, Document No. TI–1770 ED&DS 12.92.

Translation of an article from the German Trade Journal Pack Report, May 1991, pp. 98–99, "Palette Stabilization".

(List continued on next page.)

*Primary Examiner*—David A. Simmons
*Assistant Examiner*—Paul M. Rivard
*Attorney, Agent, or Firm*—Gary L. Griswold; Waltner N. Kirn; Charles D. Levine

[57] ABSTRACT

A continuous tape supply apparatus is provided in accordance with the present invention for supplying tape at a substantially consistent tension to a tape applicator machine having an indexing demand, such as a box sealing and taping machine. In general, the continuous tape supply apparatus includes plural tape sources, such as in roll form, from which tape can be supplied to the tape applicator machine, a splicing station for splicing the tape from at least one of the tape sources to another of the tape sources, a means for causing the splice and thus the changeover of tape from one source to another, and a tension control means for providing the tape from the continuous tape supply apparatus at a substantially consistent tension under an indexing demand. Preferably, the splicing mechanism also splices tape in the reverse order from the other tape source station back to the first tape source stations. The tension control means is preferably provided by a tape drive station, a first dancer arm providing a variable loop forming means between each of the tape supply sources and the splicing station, and a second dancer arm positioned operatively after the tape drive station which is located operatively after the splicing station. The first dancer arm is further preferably used to control a braking mechanism which together eliminate roll inertia effects to the splicing station. The second dancer arm is also advantageously used to control the speed of the motor drive of the tape drive station.

15 Claims, 27 Drawing Sheets

U.S. PATENT DOCUMENTS

| | | | |
|---|---|---|---|
| 3,574,414 | 4/1971 | Jacob | 303/7 |
| 3,738,587 | 6/1973 | Cristiani | 242/58.1 |
| 3930,442 | 1/1976 | Buttner | 100/518 |
| 3,939,032 | 2/1976 | Taitel et al. | 156/505 |
| 4,014,217 | 3/1977 | Lagasse et al. | 73/432 F |
| 4,095,395 | 6/1978 | Goldstein | 53/198 R |
| 4,100,012 | 7/1978 | Meihofer et al. | 156/504 X |
| 4,109,445 | 8/1978 | Shulman | 53/198 R |
| 4,113,197 | 9/1978 | Harrington et al. | 242/58.1 |
| 4,172,564 | 10/1979 | Romagnoli | 242/58.3 |
| 4,203,796 | 5/1980 | Larsson | 156/504 |
| 4,204,377 | 5/1980 | Lancaster et al. | 53/399 |
| 4,209,961 | 7/1980 | Donnelley | 53/588 |
| 4,222,533 | 9/1980 | Pongracz | 156/502 X |
| 4,230,519 | 10/1980 | DuBroff | 156/468 |
| 4,235,062 | 11/1980 | Lancaster, III et al. | 53/399 |
| 4,255,918 | 3/1981 | Lancaster et al. | 53/556 |
| 4,264,401 | 4/1981 | Ganz | 156/504 |
| 4,271,657 | 6/1981 | Lancaster, III et al. | 53/399 |
| 4,279,717 | 7/1981 | Eckberg et al. | 204/159 |
| 4,302,920 | 12/1981 | Lancaster et al. | 83/399 |
| 4,315,238 | 2/1982 | Eventoff | 338/99 |
| 4,331,301 | 5/1982 | Martinez | 242/58.1 |
| 4,342,815 | 8/1982 | Doehnert | 428/522 |
| 4,346,853 | 8/1982 | Stefanoni et al. | 242/58.1 |
| 4,347,505 | 8/1982 | Anderson | 340/666 |
| 4,365,710 | 12/1982 | Swanson | 206/386 |
| 4,369,614 | 1/1983 | Tetzner | 53/556 |
| 4,390,388 | 6/1983 | Nagata et al. | 156/351 |
| 4,417,940 | 11/1983 | Koster | 156/351 |
| 4,429,514 | 2/1984 | Lancaster et al. | 53/556 |
| 4,432,185 | 2/1984 | Geisinger | 53/138 R |
| 4,444,998 | 4/1984 | House | 178/19 |
| 4,460,430 | 7/1984 | Kissell et al. | 156/504 |
| 4,492,609 | 1/1985 | Blom | 156/507 |
| 4,494,105 | 1/1985 | House | 338/114 |
| 4,534,420 | 8/1985 | Goldelius | 173/12 |
| 4,543,152 | 9/1985 | Nozaka | 156/502 |
| 4,549,388 | 10/1985 | Lancaster | 53/556 |
| 4,555,070 | 11/1985 | Pali | 242/58.1 |
| 4,563,863 | 1/1986 | Humphrey | 53/556 |
| 4,629,531 | 12/1986 | Kataoka | 156/504 |
| 4,643,783 | 2/1987 | Hogenson | 156/64 |
| 4,652,329 | 3/1987 | Focke | 156/351 |
| 4,671,043 | 6/1987 | Forni et al. | 53/399 |
| 4,676,048 | 6/1987 | Lancaster et al. | 53/399 |
| 4,683,022 | 7/1987 | Watanabe et al. | 156/505 |
| 4,693,060 | 9/1987 | Born | 53/588 |
| 4,695,007 | 9/1987 | Muto et al. | 242/58.4 |
| 4,739,299 | 4/1988 | Eventoff et al. | 338/99 |
| 4,769,098 | 9/1988 | Cederholm et al. | 156/159 |
| 4,772,350 | 9/1988 | Gamberini | 156/366 |
| 4,807,427 | 2/1989 | Casteel et al. | 53/556 |
| 4,810,992 | 3/1989 | Eventoff | 338/99 |
| 4,842,681 | 6/1989 | Bader et al. | 156/504 |
| 4,845,920 | 11/1989 | Lancaster | 53/399 |
| 4,848,691 | 7/1989 | Muto et al. | 242/58.1 |
| 4,859,270 | 8/1989 | Martin et al. | 156/361 |
| 4,878,986 | 11/1989 | Nishikawa | 156/504 |
| 4,892,611 | 1/1990 | Wheeler et al. | 156/504 |
| 4,893,981 | 1/1990 | Yoshinada et al. | 414/5 |
| 4,906,319 | 3/1990 | Fiorani | 156/353 |
| 4,908,091 | 3/1990 | Traegaardh et al. | 156/502 |
| 4,917,327 | 4/1990 | Asbury, Jr. et al. | 242/156 |
| 4,951,893 | 8/1990 | Yuito | 242/58.1 |
| 4,955,181 | 9/1990 | Casteel | 53/556 |
| 4,961,963 | 10/1990 | Peters | 427/208.8 |
| 4,963,702 | 10/1990 | Yaniger et al. | 178/18 |
| 4,968,766 | 11/1990 | Kendziorski | 528/32 |
| 4,975,676 | 12/1990 | Greenhalgh | 338/114 |
| 4,984,750 | 1/1991 | Shigeta et al. | 242/58.1 |
| 4,991,381 | 2/1991 | Simons | 53/556 |
| 4,995,224 | 2/1991 | Yourgalite et al. | 53/540 |
| 4,995,404 | 2/1991 | Nemir | 128/777 |
| 4,995,936 | 2/1991 | Cohn | 156/504 |
| 5,003,752 | 4/1991 | Matsumoto | 53/399 |
| 5,012,591 | 5/1991 | Asakawa | 33/832 |
| 5,020,736 | 6/1991 | Thievessen | 242/58.3 |
| 5,029,768 | 7/1991 | Asbury, Jr. et al. | 242/58.1 |
| 5,033,688 | 7/1991 | Georgitsis et al. | 242/58.1 |
| 5,045,134 | 9/1991 | Schenker et al. | 156/361 X |
| 5,053,096 | 10/1991 | Long et al. | 156/157 |
| 5,053,585 | 10/1991 | Yaniger | 178/18 |
| 5,060,527 | 10/1991 | Burgess | 73/862.68 |
| 5,064,488 | 11/1991 | Dickey et al. | 156/361 X |
| 5,066,346 | 11/1991 | Long et al. | 156/157 |
| 5,072,361 | 12/1991 | Davis et al. | 364/167.01 |
| 5,086,785 | 2/1992 | Gentile et al. | 128/782 |
| 5,137,338 | 8/1992 | Ingraham | 303/3 |
| 5,145,108 | 9/1992 | Pinckney et al. | 229/117.26 |
| 5,190,234 | 3/1993 | Ezekiel | 156/504 X |
| 5,230,458 | 7/1993 | Asanasavest | 228/102 |
| 5,266,737 | 11/1993 | Okamoto | 84/626 |

OTHER PUBLICATIONS

"State of the Art Unitizing: How to get it all together–and keep it that way", Package Engineering, 27, Aug. 28, 1980.

Article entitled: "Interlink has the touch" *New Devices Based on FSRS*, Wescon/90 (Booth 2176).

John Haystead, "Profile in Innovation: FSR technology is at the heart of miniature pointing device" *EDN* Products & Careers Edition (Mar. 25, 1993) p. 13.

"Sensors and Systems: A Keyboard Controlled Joystick Using Force Sensing Resistors" *Sensors* (Apr. 1991) pp.38–39.

"Touch the Future . . . through Force Sensing Resistors from Interlink Electronics" (Rev Aug. 15, 1989); TechNotes: Suggested Interfaces (Rev Sep. 1990) and FSR™ Integration Guide & Evaluation Parts Catalog (no date); Promotional material from Interlink Electronics, Camarillo, CA.

Spectra Symbol Data Sheets: "Membrane Switches," Softpot (Membrane Potentiometer), Product–Membrane Joystick, Product–Multiple Sealed Potentiometers (no date); Promotional Material from Spectra Symbol Corp., Salt Lake City, UT.

Daniel Czernik and Frank Miszczak (Force Imaging Technologies), "Real time gasket stress management" *Automotive Engineering*, vol. 100, No. 1 (Jan. 1992) pp. 9–13.

"Dynaforce: System Information Sheet," Force Imaging Technologies, Inc., Chicago, IL, 1992 (Form No. 2301–92).

"This Sensor is Thinner than a Piece of Paper . . . , "*Uniforce Technology*; Promotional material from Force Imaging, 1994 (Form 2299–94).

TAPE SUPPLY AND APPLICATOR SYSTEM INCLUDING A TAPE SPLICING MECHANISM

This is a continuation of application Ser. No. 08/437,516 filed May 9, 1995, now abandoned, which is a continuation of application Ser. No. 08/067,240, filed May 26, 1993, now abandoned.

TECHNICAL FIELD

The present invention relates to the combination of a tape applicator machine such as a box sealing machine, which are commonly referred to as case sealers, and a tape supply system. More specifically, the present invention includes a tape supply system for providing an uninterrupted supply of tape.

BACKGROUND OF THE INVENTION

In the supplying of any type of web materials from finite length supplies such as in roll form, including papers, films, woven and non-woven fabrics, adhesive tapes or the like, to be converted or otherwise applied to another material in a production line setting, it is desirable to minimize production line downtime caused by changing from one supply roll to another. One way of minimizing downtime is to use larger capacity rolls. A way of eliminating downtime is to provide for a changeover without interrupting the continuous material supply.

Under such continuous demand situations, it is known to incorporate a splicing mechanism into the web material supply to effect a roll changeover from a depleted roll to a new roll while the demand continues; that is, without stopping the supply of web material to the conversion or application systems. Typically, a new supply roll will be loaded onto the splicing mechanism in a ready position so that upon depletion of the current supply roll (or upon the expectation of such event), a leading edge of the new roll will be relatively moved to adhere or be otherwise connected to the remaining web material of the depleted roll. Upon such connection, the new roll will provide the currently demanded supply, and yet another roll can be readied for the next changeover.

Splicing mechanisms suitable for such use can be classified as either of the type that splices the new web material to the currently demanded web material while it is in motion, hereinafter referred to as an "on the fly" splicing mechanism, or of the type that splices the new web to the demanded web while it is temporarily stopped, hereinafter referred to as a "zero speed" splicing mechanism.

On the fly mechanisms may bring the web material of the new roll up to the demand speed before splicing or may let the demanded web material pick up the new web material from a lower speed or a stationary position. Zero speed splicing mechanisms must provide for a temporary supply of web material downstream from the splicing mechanism through which the demanded web material runs so that the web material can be temporarily stopped within the splicing mechanism during the splice. The capacity of the temporary supply must be sufficient to provide for the continuous demand for the time period over which the splice takes place. Usually, such capacity is provided by an accumulator comprising a loop or series of loops, hereinafter referred to as a festoon, which can be decreased in size during the continued demand while the web material is stopped at the splicing mechanism. The size of the festoon is then gradually increased to full capacity after the splice is completed. An obvious advantage of the on the fly splicing mechanisms is that they do not require the provision of a festoon after the splice mechanism. However, with the on the fly mechanisms, it is essential that the splice be precisely controlled so as to reliably effect such a connection of a new web to a moving web.

Examples of known apparatuses for splicing a web to another web, and in particular from a replacement web to a moving web are disclosed in U.S. Pat. Nos. 4,172,564 to Romagnoli, 4,264,401 to Ganz, 4,848,691 to Muto et al., 5,033,688 to Georgitsis et al., and 5,064,488 to Dickey. Each of these, however, deals with the situation of splicing one web to a moving web under a continuous and constant demand for the web material.

Although such splicing techniques for splicing one roll of a web material to another roll of web material, including the splicing of one adhesive tape to another adhesive tape, are known under continuous demand situations, such splicing techniques have heretofore not been utilized in an intermittent demand situation. Under a continuous demand situation, the tension within the web remains substantially constant over the use of the entire roll by virtue of the even demand. Thus, splicing can be effectively controlled. To the contrary, an intermittant demand of the web material from the supply roll causes the tension within the web to fluctuate. Thus, in addition to supplying the web material, the tension thereof should be controlled to provide a substantially even tension throughout each demand cycle to minimize web feeding problems and failures.

Moreover, when dealing with the supplying of adhesive tape from a supply roll to a tape applicator machine, the stripping tension, that is the tensile force that is required to pull the adhesive tape from the roll, is very often significantly higher than the desired tension of the tape as it is supplied to the applicator machine. Thus, it may also be desirable to perform a reduction in the tape tension after it is stripped from its roll and before it is fed to the applicator machine. In the case of an intermittent demand type tape applicator machine, both tension reduction and tension evening may be necessary. Thus, any attempted splicing must also be accomplished within these difficult to control tension requirements.

Tape applicator machines are used in many ways for applying continuous lengths of tape or discrete lengths of tape to a variety of objects that are moved relative to the tape applicator. Of such tape applicator machines, one specific type is box sealing machines, also known as case sealers, which apply a length of tape to a box or carton to seal the box by taping the top flaps together.

Such box sealing machines may apply a length of tape in a configuration known as a C-clip which is applied with a portion of the tape to a front vertical portion of the box, over the top to seal the top flaps together, and then down a portion of the rear vertical wall. Otherwise L-clips of tape are sometimes provided at either the front or rear edges of the box or both, or a length of tape is adhered only to the top surface to connect the flaps. In any case, these machines have in common that the tape is demanded intermittently. In other words, tape is demanded from its supply as a length of tape is applied to one of such boxes or cartons by a tape applicator, and then the tape demand is stopped for a moment until the next box is positioned relative to the tape applicator for the next application. Moreover, typical intermittant tape demand of a box sealing machine, hereinafter referred to as indexing demand, can be characterized generally as a square wave representing an immediate demand upon the start of application of tape to a box up to the level (rate) of demand that is then substantially constant during the application of the tape length to the box until demand is ceased immediately upon the cutting of the length of tape from its supply roll.

Such intermittent applications may occur indefinitely as the boxes or cartons are fed along a continuous packaging line. However, such applicator machines have in the past been provided with only a limited supply of such adhesive tape. Thus, at some regular interval, the packaging line must be stopped so that a new roll of tape can be loaded into the applicator machine. Moreover, with the increasingly high demands for such packaging lines, which demand as much as about 200 feet of tape per minute (61 meters per minute), the interval may be too short requiring even more down time of the packaging line.

One attempt at minimizing the down time of production packaging lines, particularly those which run at relatively high speeds, is the designing and making of larger rolls of tapes. Moreover, specially wound tape rolls have been developed which provide as much as six times the amount of tape found in a typical tape roll. Such specially wound tape rolls are available from Minnesota Mining and Manufacturing Company of St. Paul, Minn. under the trademark Opta-pak. Although these rolls effectively minimize down time of a packaging line, they still must, by the virtue of the fact that they are a definite length, require some down time of the production line in order to change to a new roll.

The intermittent demand of such box sealing machines and similar applicators require that the tape tension be effectively controlled during the intermittent demand for smooth unwinding of the tape from the roll. Moreover, in many cases, a relatively high tension in the order of 3.5 lbs is necessary to strip the tape from its roll. On the other hand, the application of the tape to the objects should preferably be done at a relatively low tension of below 1 lb. Thus, it is important to effectively strip the tape from the roll at the required high tension while applying the tape to the objects at the relatively low tension and doing so smoothly under the indexing demand, described above, so as to minimize tape jams, failures or damage to boxes or cartons.

The present invention deals with the supplying of an uninterrupted supply of tape to such an intermittent demand tape applicator machine. Moreover, the present invention utilizes a tape splicing technique for providing the continuous length of tape and does so while accommodating the aforementioned tension requirements.

Other apparatuses have been developed for application of a discrete length of a web material, such as a deadening strip, to a portion of the continuous length of adhesive tape supplied in roll form and as thereafter applied on intermittent demand. Such devices have been used to provide tabs or handle portions, or the like to the length of tape as applied to a box or carton. Examples of tape handle producing and applying apparatuses are described in U.S. Pat. Nos. 4,906,319 to Fiorani and 5,145,108 to Pinckney et al. Moreover, an example of a device for providing tabs to the adhesive tape to facilitate removal of the tape from boxes is described in commonly owned U.S. patent application Ser. No. 08/002,194. None of these devices, however, provide a changeover operation from one roll to another. Such changeover operation is a critical part of a continuous tape supply system which requires that a plurality of tape rolls must be accommodated and controlled under the above-noted tensioning requirements.

SUMMARY OF THE PRESENT INVENTION

A continuous tape supply apparatus is provided in accordance with the present invention for supplying tape at a substantially consistent tension to a tape applicator machine having an indexing demand. In general, the continuous tape supply apparatus includes plural tape sources from which tape can be supplied to the tape applicator machine, a splicing station for splicing the tape from at least one of the tape sources to another of the tape sources, a means for causing the splice and thus the changeover of tape from one source to another, and a tension control means for providing the tape from the continuous tape supply apparatus at a substantially consistent tension under an indexing demand.

Moreover, the splicing mechanism is also capable of splicing tape in the reverse order from the other tape source station back to the first tape source stations.

The tension control means is preferably provided by a variable loop forming means, such as a dancer arm, which defines a tape capacity and which is provided within the tape guide system of the tape from the tape supply sources. Such a variable loop forming means can be provided operatively before or after the splicing station. In the case of a splicing mechanism that splices while the currently demanded tape is in motion, it is desireable to provide at least some of the capacity, that is a variable loop forming means, before the splicing station. Where the splicing mechanism effects the splice while the tapes are stopped, some capacity, such as a variable loop forming means, must be provided operatively after such a splicing mechanism.

In accordance with the preferred embodiment of the present invention, the tension control means comprises a tape drive station, a first dancer arm providing a variable loop forming means between each of the tape supply sources and the splicing station, and a second dancer arm positioned operatively after the tape drive station which is located operatively after the splicing station. The first dancer arm is further preferably used to control a braking mechanism which together eliminate roll inertia effects to the splicing station. The second dancer arm is also advantageously used to control the speed of the motor drive of the tape drive station. This provides a closed loop system for providing a consistent tape tension from the continuous tape supply apparatus under an indexing demand situation.

It is a further aspect of the present invention to combine such a continuous tape supply apparatus with a indexing demand type tape applicator machine. More specifically, such a tape applicator machine which is advantageously used in combination with the continuous tape apparatus of the present invention is a box sealing machine.

In yet another aspect of the present invention, an electrical position sensor comprising a force sensing device is preferably used to relate the dancer arm position to a control voltage for determining motor speed. More specifically, such a force sensing device is used to relate the position of the dancer arm positioned after the tape drive station so as to control the motor speed of the tape drive station for controlling tape tension. Such an approach advantageously achieves a more responsive and smoother tape drive operation than with conventional proximity switches.

The above and other features and advantages of the subject invention and the manner of achieving them will become more apparent from the following detailed description and the appended claims, with reference to the attached drawings showing preferable embodiments of the present invention.

BRIEF DESCRIPTION OF THE DRAWINGS

FIG. 14 illustrates the splicing station with tape being demanded from a first roll while tape from another roll is provided in a ready splice position;

FIG. 15 is a view of the splicing station just after a splice has been instigated with the tapes of the first and second rolls contacted with one another;

FIG. 16 is a view of the splicing station with the tape splice continuing while tape is demanded from both tape rolls;

FIG. 17 is a view of the splicing station with the splice formation continued but with the first roll of tape cut and with tape only being demanded from the second roll of tape;

FIG. 18 is a view of the splicing station after the splice is complete and tape is demanded from only the second roll of tape;

FIG. 19 is a view of the splicing station with tape being demanded from the second roll of tape and the splicing mechanism being initially prepared for a new roll of tape to be substituted for the depleted first roll;

FIG. 20 is a view of the splicing station with the tape from the new roll of tape being prepared for the next splicing operation;

FIG. 21 is a view of the splicing station with the new roll of tape threaded to the splicing station and held in place;

FIG. 22 is a view of the splicing station with a first manipulation of the latching mechanism for selectively positioning the latch thereof between the first and second lever mechanisms of the splicing station;

FIG. 23 is an enlarged perspective view of the latching mechanism in the position shown in FIG. 22;

FIG. 24 is a view of the splicing station with a further manipulation whereby the latch is switched from its engagement position with the second lever mechanism to that of the first lever mechanism;

FIG. 25 is an enlarged perspective view of the latching mechanism in its position of FIG. 24;

FIG. 26 is a view of the splicing station with the second lever mechanism positioned in its running position and the latching mechanism in its disabled position;

FIG. 27 is a view of the splicing station with the second lever mechanism in its running position, the first lever mechanism in its ready splicing position, and the latching mechanism in its disabled position;

FIG. 28 is a view of the splicing station with the first lever mechanism ready for splicing, the second lever mechanism in its running position, and the latching mechanism enabled;

FIG. 29 is an enlarged perspective view of the latching mechanism positioned as in FIG. 28.

DETAILED DESCRIPTION OF THE PREFERRED EMBODIMENTS

Figure 1:
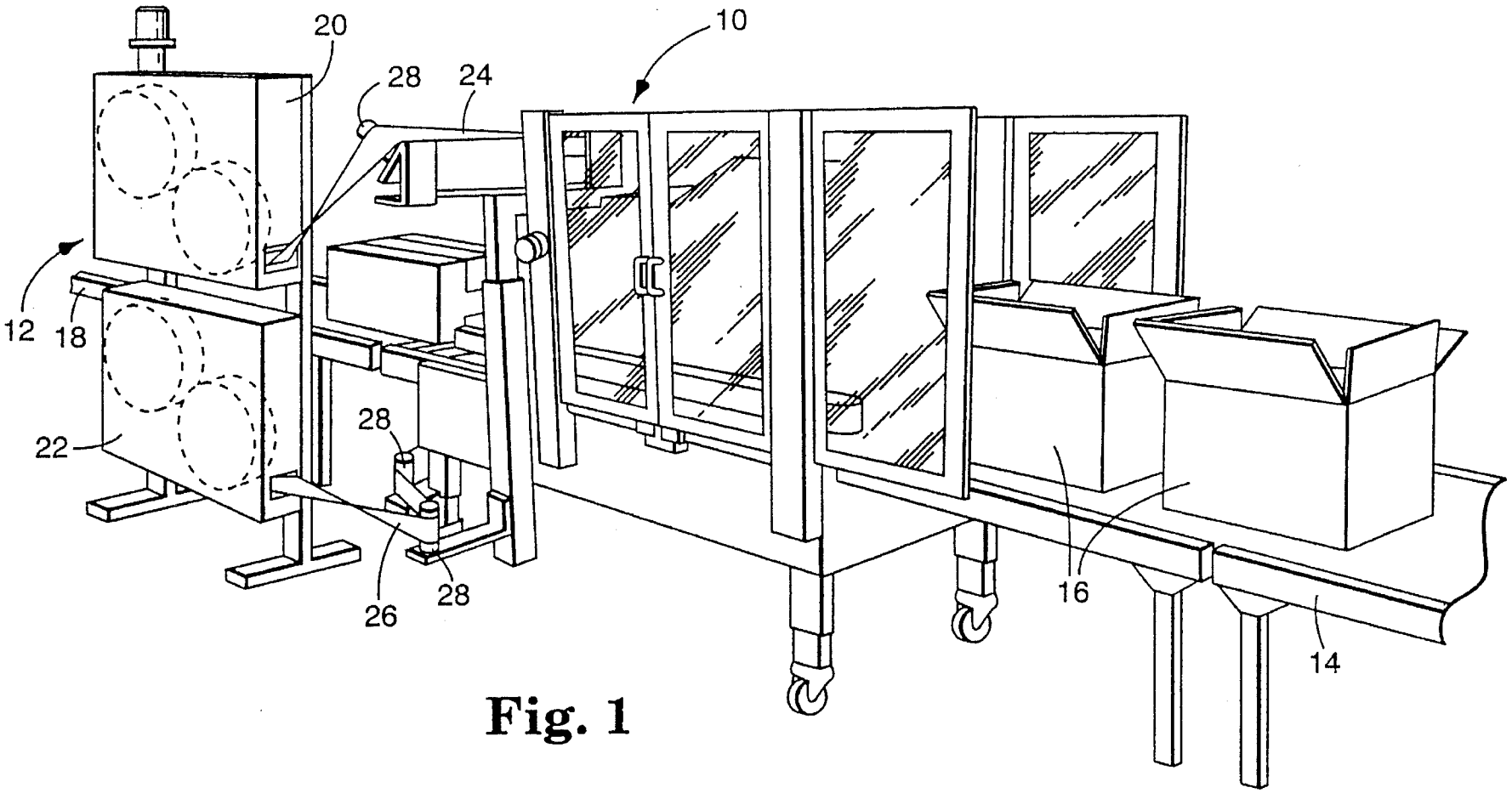
FIG. 1 is perspective view showing the combination of a plurality of continuous tape supply stations with a box sealing machine in accordance with the present invention.

With reference now to the drawings, wherein like components are designated with like numerals throughout the several figures, and initially to FIG. 1, a box closing and tape sealing system is illustrated generally comprising a box closing and taping machine 10 and a continuous tape supply system 12. A conveyor system 14 brings the boxes or cartons 16 to the box closing and taping machine 10, which preferably folds the top flaps of the boxes 16 and applies a length of adhesive tape to both the upper and lower surfaces of the boxes 16 in order to seal the top and bottom flaps. A second conveying system 18 transports the closed and sealed boxes from the box closing and taping machine 10.

The box closing and taping machine 10 may comprise any known box taping machine which applies a length of tape to either the top or bottom or both of the boxes 16. One specific box closing and taping machine is described in commonly owned U.S. Pat. application Ser. No. 808,107 filed Dec. 16, 1991, the complete disclosure of which is fully incorporated herein by reference, and which is commercially available from Minnesota Mining and Manufacturing Company of St. Paul, Minn. under the trademark 3M-Matic Model 800 AF.

The box taping machine 10 may comprise a single taping head (not shown) comprising an upper taping head or a lower taping head for taping either the upper surface or lower surface of a box conveyed through the machine, respectively, or may include both an upper and a lower taping head for taping both the upper and lower box surfaces, respectively. Such taping heads are also commercially available from Minnesota Mining and Manufacturing Company of St. Paul, Minn. under the trademark Accu-Glide II. It is further understood that any tape applicator machine, box taping machine, or box closing and taping machine could be combined with the continuous tape supply system 12 in accordance with the present invention.

Box taping machines 10 are characterized in that they have an intermittent demand for tape in the application thereof to boxes or cartons moved through the machines. For each box 16 that passes through the box taping machine 10, a definite length of tape is dispensed and applied to each box individually. Thus, for at least a moment between applications to successive boxes 16, there is no demand. Accordingly, the continuous tape supply system 12 must not only supply an uninterrupted length of tape at a usable tension of the box taping machine 10, it must be able to do so with an intermittent demand.

Moreover, the box taping machine 10 together with the conveyor systems 14 and 18 typically comprise part of a packaging production line, and should preferably be able to handle the boxes at the same speed as the packaging production line. Currently, speeds of such packaging lines translate to the need for tape to be dispensed from the tape supply system 12 at speeds of up to 200 feet/minute (61 meters/minute). Of course, the greater the demand for the tape, the more often that tape rolls of definite length must be replaced. It is thus a specific advantage of the present invention, that even within high speed packaging lines, a continuous tape supply can be provided without the need for shutting down the box taping machine 10 periodically to have the rolls of tape changed. Moreover, as the dispensing speed is increased, the tension within the tape during demand increases which further results in a greater need for tension control within the supply station, as will be more fully understood from the description of the function of the present invention below.

As shown in FIG. 1, the continuous tape supply system 12 comprises both an upper continuous tape supply station 20 and a lower continuous tape supply station 22. Both upper and lower stations 20 and 22 are provided in accordance with the illustrated embodiment combined with a box closing and taping machine 10 that includes both an upper taping head and a lower taping head. Each of the upper and lower continuous tape supply stations 20 and 22 include a plurality of rolls of box sealing tape, which is supplied to the upper and lower taping heads of the box closing and taping machine 10 at 24 and 26, respectively. Tapes 24 and 26 are effectively guided by conventional guide elements 28 to the upper and lower taping heads, respectively. Moreover, the plural tape rolls provided within each of the upper and lower continuous tape supply stations 20 and 22 alternately supply the upper and lower tapes 24 and 26 without interruption, as will be more fully understood from the description of the continuous tape supplies system 12 described below.

Figure 2:
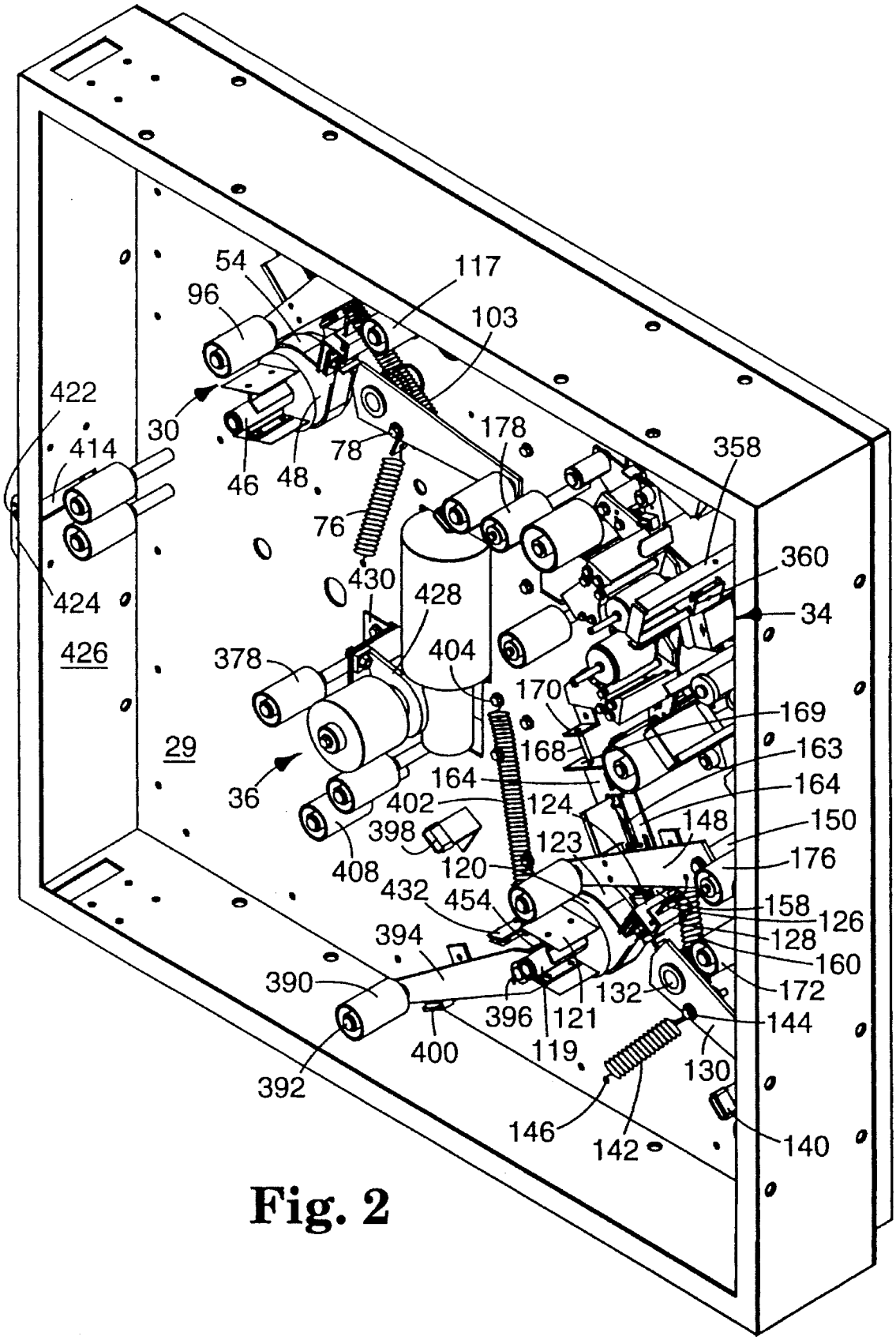
FIG. 2 is an isometric view of a continuous tape supply station in accordance with the present invention.
Figure 3:
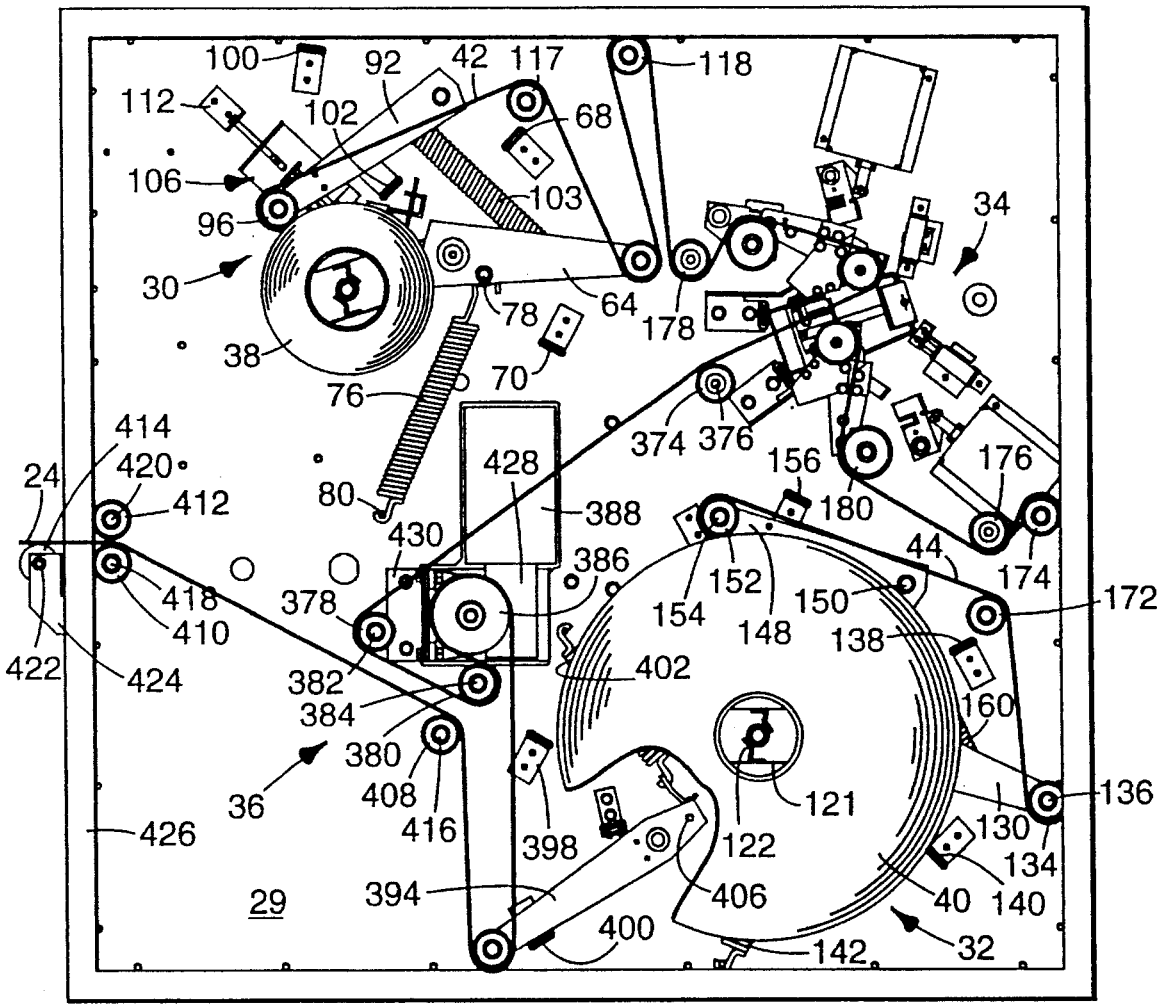
FIG. 3 is front view of the continuous tape supply station shown in FIG. 2 including plural rolls of tape supported in position on the supply station and showing a first roll in a running tape supplying mode and a second roll in a ready for splice position.

With reference now to FIGS. 2 and 3, the upper continuous tape supply station 20 will be described with the understanding that the description is equally applicable to the lower continuous tape supply station 22 which is preferably identical to the upper continuous tape supply station 20. The tape supply station 20 basically comprises a first roll unwind station 30, a second roll unwind station 32, a splicing station 34 and a tape drive station 36. In general, at any given time except when a splice is occurring, adhesive tape is supplied from a tape roll 38 or 40 provided on the first and second roll unwind stations 30 and 32, respectively through the splicing station 34, around the tape drive station 36 and then is guided from the continuous tape supply station 20 for use by a box closing and taping machine 10.

Moreover, the tape 24 exits the continuous tape supply station 20 at a relatively low tension, that is preferably below 1 lb, which is required for use by a typical box closing and taping machine 10. This relatively low tension is contrasted with the relatively high tension that is often required in order (depending on the type of tape) to strip the adhesive tape from either the first or second roll of tape 38 or 40, respectively, which may be in the order of 3.5 lbs.

As shown in FIG. 3, tape 42 is stripped from the first roll of tape 38, it passes through the splicing station 34, through the tape drive station 36, and becomes the tape 24 exiting the continuous tape supply station 20. Tape 44 is stripped from tape roll 40 provided on the second roll unwind station 32, and the tape 44 is guided to the splicing station 34, and is in a ready position to be spliced with the tape 42 from the first roll 38 upon exhaustion (or the expectation thereof) of the tape 42 from the first roll 38. The splicing operation will be more fully described below, and after a splice takes place from the configuration shown in FIG. 2, the tape 44 from the second roll 40 will pass through the splicing station 34, through the tape drive station 36, and will exit the continuous tape supply station 20 as tape 24, and the tape 42 from a new roll of tape 38 provided on the first roll unwind station 30 will be guided to the splicing station 34 and provided in a ready position for the next subsequent splice. The alternating operation of tape from the first and second rolls 38 and 40 will continue so long as the depleted rolls are replaced while the other roll is supplying the tape 24.

Figure 4:
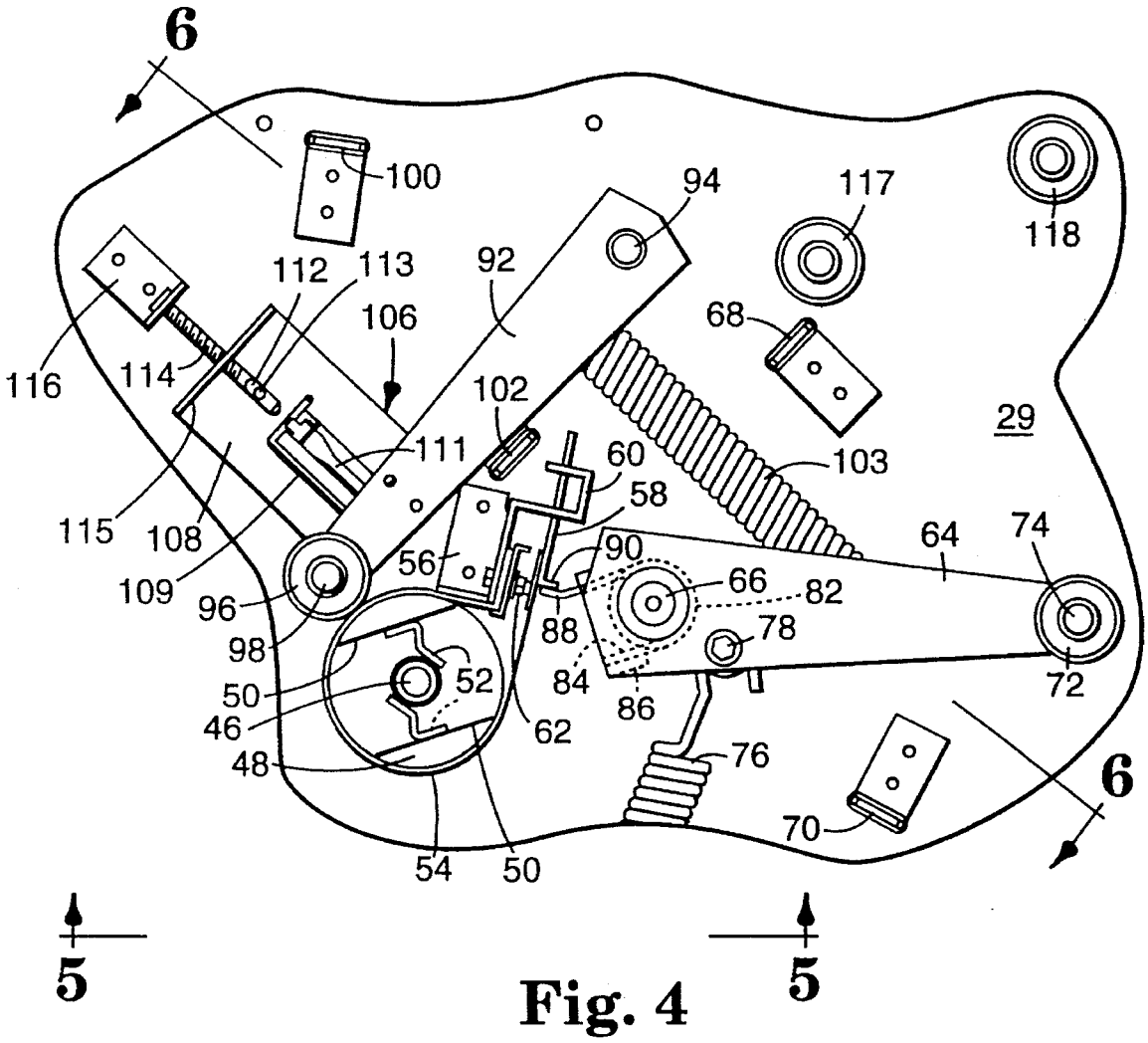
FIG. 4 is an enlarged view of a portion of the continuous tape supply station shown in FIG. 3 of a first tape unwind station with the tape roll removed.
Figure 6:
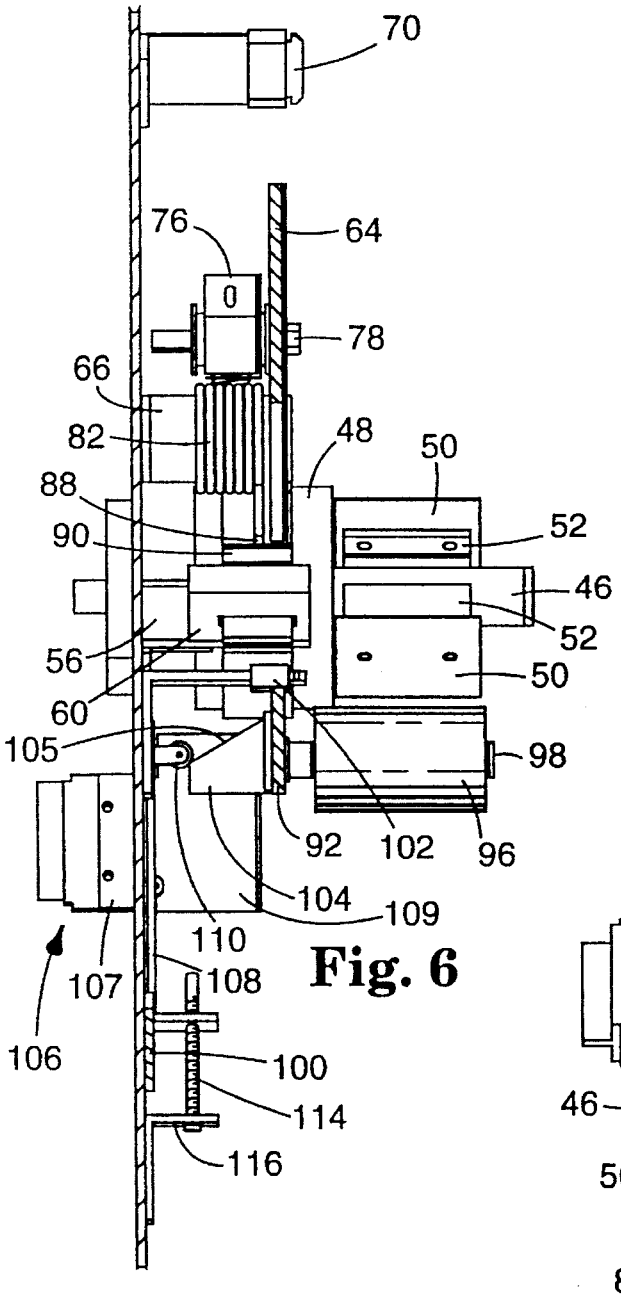
FIG. 6 is a cross-sectional view taken along line 6—6 in FIG. 4.
Figure 5:
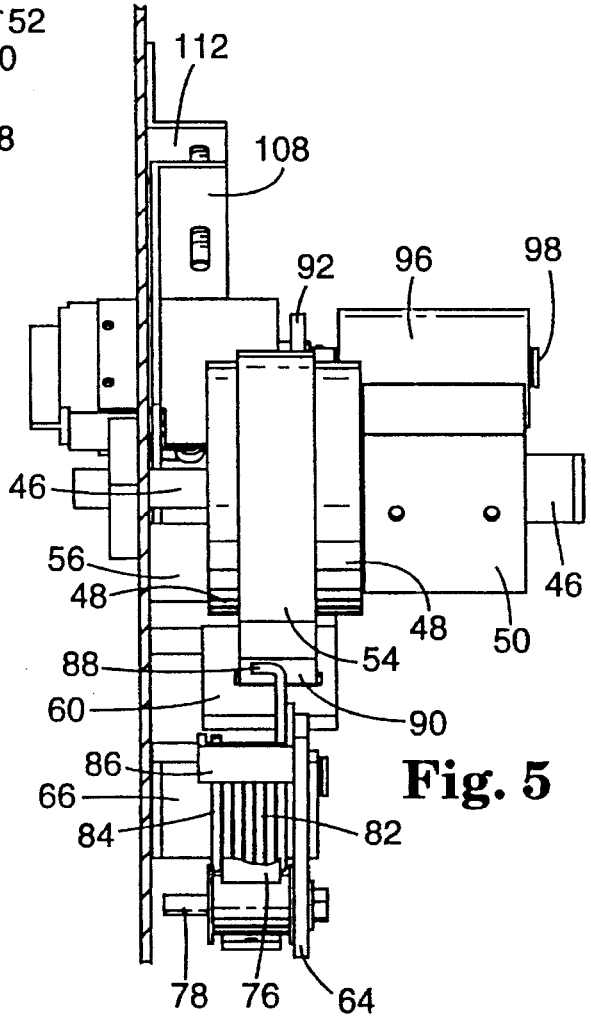
FIG. 5 is a cross-sectional view taken along line 5—5 in FIG. 4.

With reference now to FIGS. 4–6, the first roll unwind station 30 will be described. A hub 46 is rotatably supported by the support plate 29 of the continuous tape supply station 20. The hub 46 is freely pivotally mounted in a conventional manner. The hub 46 comprises a brake drum 48 and a set of spaced leaf springs 50 which are connected with the brake drum 48 by brackets 52. The leaf springs 50 and brackets 52 provide the support for the first roll of tape 38 whereby the spaced leaf springs 50 are frictionally inserted within the core of the roll of tape 38. The leaf springs 50 insure an adequate frictional engagement so that the roll of tape 38 is operatively fixed to rotate with the hub 46.

A band brake 54 is fixed at one end thereof to a brake support 56 which is located adjacent to the hub 46. The brake support 56 holds a first end of the band brake 54 in a fixed position substantially tangent to the brake drum 48. The band brake 54 is wrapped around the brake drum 48, and the other end thereof extends substantially tangentially away from the brake drum 48 and is movably connected to the brake support 56 by way of a sliding element 58 that is fixed with the other end of the band brake 54 and is slidably supported in a bracket 60 fixedly connected with the brake support 56. Preferably, the band brake 54 wraps about 270° of the brake drum 48, and comprises any conventional band brake material, such as conveyor belting for engaging with the external surface of the brake drum 48. As shown in FIG. 4, a bolt 62 is preferably provided for connecting the first end of the band brake 54 to the brake support 56 and extends sufficiently toward the other end of the band brake 54 to slidably engage it and space the moving end of the band brake 54 from the fixed end thereof at a definite distance.

A dancer arm 64 is also pivotally supported from the support plate 29 by way of a pin 66 so as to be freely rotatable on the support plate 29 as limited by an upper stop 68 and a lower stop 70 both fixedly secured to the support plate 29 and defining the range of motion of the dancer arm 64. At the distal end of the dancer arm 64 from the pivot pin 66, a roller 72 is provided which is conventionally pivotally supported on the dancer arm 64 by way of an axle 74. The dancer arm 64 is further biased by a tension spring 76 that is connected between a point 78 on the dancer arm 64 and a point 80 on the support plate 29 (see FIG. 2) to bias the dancer arm 64 toward the lower stop 70.

A torsion spring 82 is further provided surrounding the pivot pin 66 of the dancer arm 64 which is used for activating and deactivating the band brake 54. Specifically, the torsion spring 82 includes a first leg 84 which limits pivotal movement of the torsion spring 82 in one rotational direction by abutting against a stop element 86 fixed with the dancer arm 64. A second leg 88 of the torsion spring 82 extends from the torsion spring 82 and is positioned to engage a flange 90 of the sliding element 58 which is connected with the band brake 54 and is slidably supported within the brake support 56. Engagement between the second leg 88 and the flange 90 urges the sliding element 58 in a direction away from the hub 46 for causing engagement of the band brake 54 with the brake drum 48. The use of the torsion spring 82 which is limited in the one rotational direction to cause the positive engagement between the second leg 88 and flange 90 is advantageous in that the band brake 54 is gradually urged into engagement with the brake drum 48 from a zero pressure position gradually to full engagement.

As another part of the first roll unwind station 30, a stripper arm 92 is conventionally pivotally supported from the support plate 29 by way of a pivot pin 94. At the distal end of the stripper arm 92 away from the pivot pin 94, a roller 96 is conventionally freely rotatably supported on an axle 98. The rotational movement of the stripper arm 92 about the pivot pin 94 is limited by an upper stop 100 and a lower stop 102, and the stripper arm 92 is preferably biased toward the lower stop 102 by a tension spring 103 so as to keep the roll 96 against the outer wrap of the roll of tape 38.

As shown best in FIG. 6, a cam element 104 is preferably provided depending downwardly from the stripper arm 92 at a point between the roller 96 and the pivot pin 94. The cam element 104 includes a cam edge 105, the purpose of which is to operatively interact with a limit switch 106 which is further operatively supported on the support plate 29. Specifically, the limit switch 106 can be any conventionally known limit switch which is used to provide a signal, preferably an electrical signal, when the stripper arm 92 reaches a specific radial position while riding against the tape roll 38. It is contemplated that many other types of limit switches or mechanisms can be utilized instead of one that generates an electrical signal, such as a mechanical link, or pneumatic means or otherwise. A suitable limit switch that provides an electrical signal is that which is commercially available from Honeywell as Model No. DT-2RU2-A7.

Preferably, the limit switch 106 comprises a microswitch 107 mounted to a sliding plate 108 by way of a bracket 109. Moreover, the microswitch 107 is preferably a two-position double-pole switch which is activated by the movement of a wheel 110 rotatably mounted to a swing arm 111 for opening and closing the microswitch 107. Such movement of the wheel 110 and swing arm 111 is controlled by the cam edge 105. Mounting of the microswitch 107 to a sliding plate 108 advantageously permits the microswitch 107 to be adjustably positioned relative to the tape roll 38 to determine the proper point of switch activation, as will be more fully described below. As illustrated, the sliding plate 108 is preferably provided with a plurality of slots 112 (only one fully shown) which slidably engage with pins 113 (one shown) extending from the support plate 29. Furthermore, to effect the adjustment, a lead screw 114 is also preferably provided which interacts with a threaded bore through the rear wall 115 of the sliding plate 108 to move and hold the sliding plate 108 along the slots 112. The lead screw 114 is further conventionally supported at an end thereof by a bracket 116 so as to be rotatable but axially fixed so that rotation of the lead screw 114 moves the sliding plate 108.

Also provided as part of the first roll unwind station 30 are rollers 117 and 118 for guiding the tape 42 along with the rollers 72 and 96 of the dancer arm 64 and the stripper arm 92, respectively, from the first roll unwind station 30 to the splicing station 34. As shown in FIG. 3, the tape 42 is stripped from the first roll 38 by way of the stripper roller 96. Note that the backside of the tape 42 rides against the stripper roller 96 while the adhesive side thereof is exposed. The stripper arm 92 and roller 96 advantageously provide a smoother stripping of the tape 42 from the roll 38 under intermittent tape demand requirements. The tape 42 then passes over the roller 117, the dancer roller 72, and then the idle roller 118. From there, the tape 42 goes to the splicing station 34, as will be described below.

When the dancer arm 64 approaches the lower stop 70, the band brake 54 is activated by way of the torsion spring 82 and sliding element 58 to stop rotation of the brake drum 48 and thus the entire hub of 46 including the roll of tape 38. Upon demand for the tape 42, during operation, the loop of tape formed by the fixed rollers 117 and 118 and the dancer arm roller 72 is decreased in size as the dancer arm 64 is urged toward the upper stop 68 against the bias of tension spring 76. As this occurs, the band brake 54 is released from the brake drum 48 to permit rotational movement of the hub 46 and tape roll 38. As the demand for tape 42 diminishes, the loop formed between rollers 117, 118 and 72 is increased as the dancer arm 64 moves toward the lower stop 70 under the influence of the tension spring 76. As this occurs, the band brake 54 is gradually applied to the brake drum 48 to stop rotation of the hub 46 and roll of tape 38.

Thus, upon intermittent demand, the tape roll 38 is effectively rotationally released while a quantity of tape 42 is stripped from the roll 38, and when the demand is diminished, the tape roll is effectively braked to prevent over rotation of roll 38. That is, roll inertia is substantially eliminated. It is understood that other-brake mechanisms could be utilized, such as a simple friction drag brake, to control roll inertia. The use of a dancer arm and band brake is preferred in that such also controls tension as described below. The stripping of tape 42 from the roll 38 is thus effectively controlled and is done so in accordance with the relatively high tension requirements that are necessary to strip the tape 42 from the roll 38.

The tension within the tape 42 from the roll 38 depends not only on the adhesive attraction of the tape to itself in the roll 38, but also on the speed that the tape 42 is demanded and the diameter of the tape roll 38 (which changes as the tape 42 is used). The unwind station 30 provided with the combination of the brake mechanism and the dancer arm 64 effectively controls a consistent tension within the tape 42 from the roll 38 throughout the diameter of the roll 38. This is important in that a consistently tensioned tape 42 is supplied to the splicing station 34 so that effective splicing can be controlled, as detailed below. Furthermore, the dancer arm 64 and thus the loop formed in the tape 42 thereby along with the rollers 117 and 118 also cause a reduction in the tension from the unwind station 30 to the splicing station 34 by removing the effects of tape roll inertia, the importance of which will be more fully described below.

The second roll unwind station 32 is basically the same as the first roll unwind station 30. Specifically, with reference to FIGS. 2 and 3, a hub 119 is rotationally supported on the support plate 29 in the same manner as the hub 46 described above. Hub 119 further comprises a brake drum 120 and a pair of spaced leaf springs 121 fixed with the hub 119 by brackets 122. The spaced leaf springs 121 securely connect the second tape roll 40 to the hub 119 so that they are rotationally connected together. A band brake 123 has a first end that extends substantially tangentially from the brake drum 120 and is fixed to the support plate 29 by a brake support 124. The other end of the band brake 123 is connected with a sliding element 126 which again extends substantially tangentially from the brake drum 120 and is slidably engaged within a slot of a bracket 128 that is further fixed with the brake support 124. The band brake 123 preferably wraps around the brake drum 120 by about 270°.

A dancer arm 130 is pivotally connected to the support plate 29 by a pivot pin 132, and includes a dancer roller 134 conventionally freely rotatably connected to the distal end of the dancer arm 130 by way of an axle 136. The dancer arm 130 is limited in rotational movement about the pivot pin 132 by an upper stop 138 and a lower stop 140. The dancer arm 130 is further biased towards the lower stop 140 by a tension spring 142 connected to the dancer arm 130 between the pivot pin 132 and the axle 136 at connection point 144 and to the support plate 29 at connection point 146.

A torsion spring (not shown) is provided about the pivot pin 132 beneath the dancer arm 130 in the same manner as the torsion spring 82 described above and provided about pin 66. Such torsion spring includes a leg portion that abuts a flange portion of the sliding element 126 to cause frictional engagement between the band brake 123 and the brake drum 120 again in the same manner as with band brake 54 and brake drum 48 described above. When the dancer arm 130 approaches its lower position defined by the lower stop 140, the band brake 123 is effectively engaged with the brake drum 120 to stop and prevent rotation of the hub 119 and thus the second tape roll 40. When the dancer arm 130 is moved upperwardly against the bias of tension spring 142 under the influence of a demand for tape 44, the band brake 123 is released and the hub 119 with second tape roll 40 is freely rotatable as the quantity of tape is demanded.

A stripper arm 148 is also pivoted to the support plate 29 at pivot pin 150 in the same manner as the above described dancer 130. A stripper roller 152 is conventionally rotatably supported by an axle 154 at the distal end of the dancer arm 148 from the pivot pin 150. The stripper arm 148 is pivotal between an upper stop 156 and a lower stop 158, and is biased towards the lower stop 158 by a tension spring 160 connected to the stripper arm 148 between pivot pin 150 and roller 152 and to the support plate 29 at a spaced connection point. As above, the stripper arm 148 and roller 152 help ensure smooth stripping of the tape 44 from the second tape roll 40 even under intermittent tape demand.

Also preferably provided on the stripper arm 148 is a cam element (not shown) which is identical to the cam element 104 described above and shown in FIG. 6 including a cam edge for operatively engaging with a second limit switch. The limit switch is preferably the same as the limit switch 106 described earlier, and preferably provides an electrical signal when the stripper arm 148 approaches its lower stop 158 indicating that the second tape roll 40 has or is about to expire. Specifically, the limit switch comprises a microswitch 163 and is mounted to a sliding plate 164 by way of a bracket 165. The sliding plate 164 is slidably guided by slots 166 therein and pins extending from the support plate 29 within the slots 166. A lead screw 168 is also preferably provided in order the make the sliding plate 164 and thus the microswitch 163 adjustable with respect to the second hub 119. Specifically, the lead screw 168 interacts with a threaded bore in the rear wall 169 of the sliding plate 164 and is rotatably supported and axially fixed by a bracket 170 fixed to the support plate 29 at a spaced distance from the rear wall 169 of the sliding plate 164. Selective rotation of the lead screw 168 positions and holds the sliding plate 164 and the microswitch 163 in a desired activation position, as will be more fully described below. Like the microswitch 107, the microswitch 163 preferably comprises a conventional two-position double-throw switch including a swing arm and wheel which react to the movement of the stripper arm 148 by virtue of the contact with the cam element (not shown) that depends therefrom.

As shown in FIG. 3, tape 44 is stripped from the second tape roll 40 by the stripper roller 152 against which the backside of the tape rides. The tape 44 is then passed over a idler roller 172 conventionally freely rotatably mounted to the support plate 29. Tape 44 is then threaded about the dancer roller 134 from which the tape is wrapped over and between a pair of conventionally rotatably mounted idler rollers 174 and 176 and then to the splicing station 34. Roller 174 is preferably a one-way clutched roller. The rollers 172 and 174 with the dancer roller 134 form a loop in the tape 44 which controls the feeding of the tape 44 from the second roll of tape 40 to the splicing station 34 under the appropriate relatively high tension requirements and the braking of the second tape roll 40 when the demand for tape is diminished.

As seen in FIG. 3, tape 42 is fed to the splicing station 34 from roller 118 to a conventionally rotationally supported roller 178, which is also preferably a one-way clutched roller. Likewise, the tape 44 is fed from roller 176 to a conventionally rotationally mounted roller 180 within the splicing station 34. The splicing station 34 is generally symmetrical and is responsible for permitting either tape 42 or tape 44 to run through the splicing station 34 without obstruction while the respective tape roll 38 or 40 supplies the tape 24 to be used by a box taping machine 10. Moreover, the splicing station 34 permits the effective changeover from either of the first or second rolls 38 and 40 to the other. This changeover includes the splicing of the tapes 42 and 44 together over a limited distance and the cutting of the tape 42 or 44 of the roll 38 or 40 being disconnected.

Figure 7:
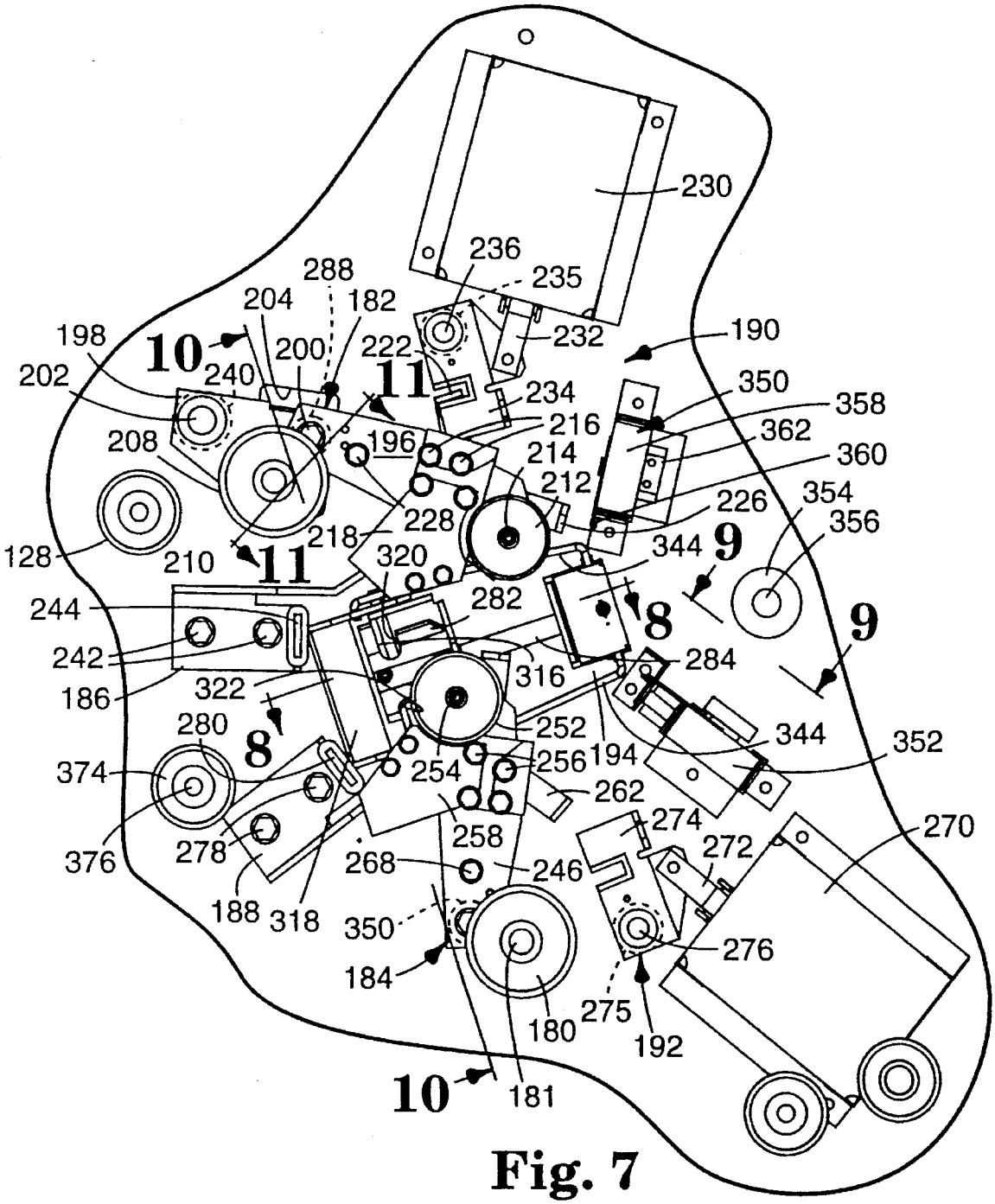
FIG. 7 is an enlarged view of the splicing station of the continuous tape supply station of FIG. 3 without tape.

Referring now to FIG. 7, an enlarged view of the splicing station 34 taken from FIG. 3 is illustrated except with tapes 42 and 44 removed. The relative positions of the components are, however, as they would be when the first tape roll 38 is supplying tape 42 while the tape 44 of the second tape roll 40 is in a position ready for splicing. The splicing station 34 basically comprises a first lever mechanism 182, a second lever mechanism 184, a first stationary blade 186, a second stationary blade 188, a first release mechanism 190, a second release mechanism 192, and a latching mechanism 194 for selectively operating to hold either of the first and second lever mechanisms 182 and 184 in a splicing ready position.

Figure 10:
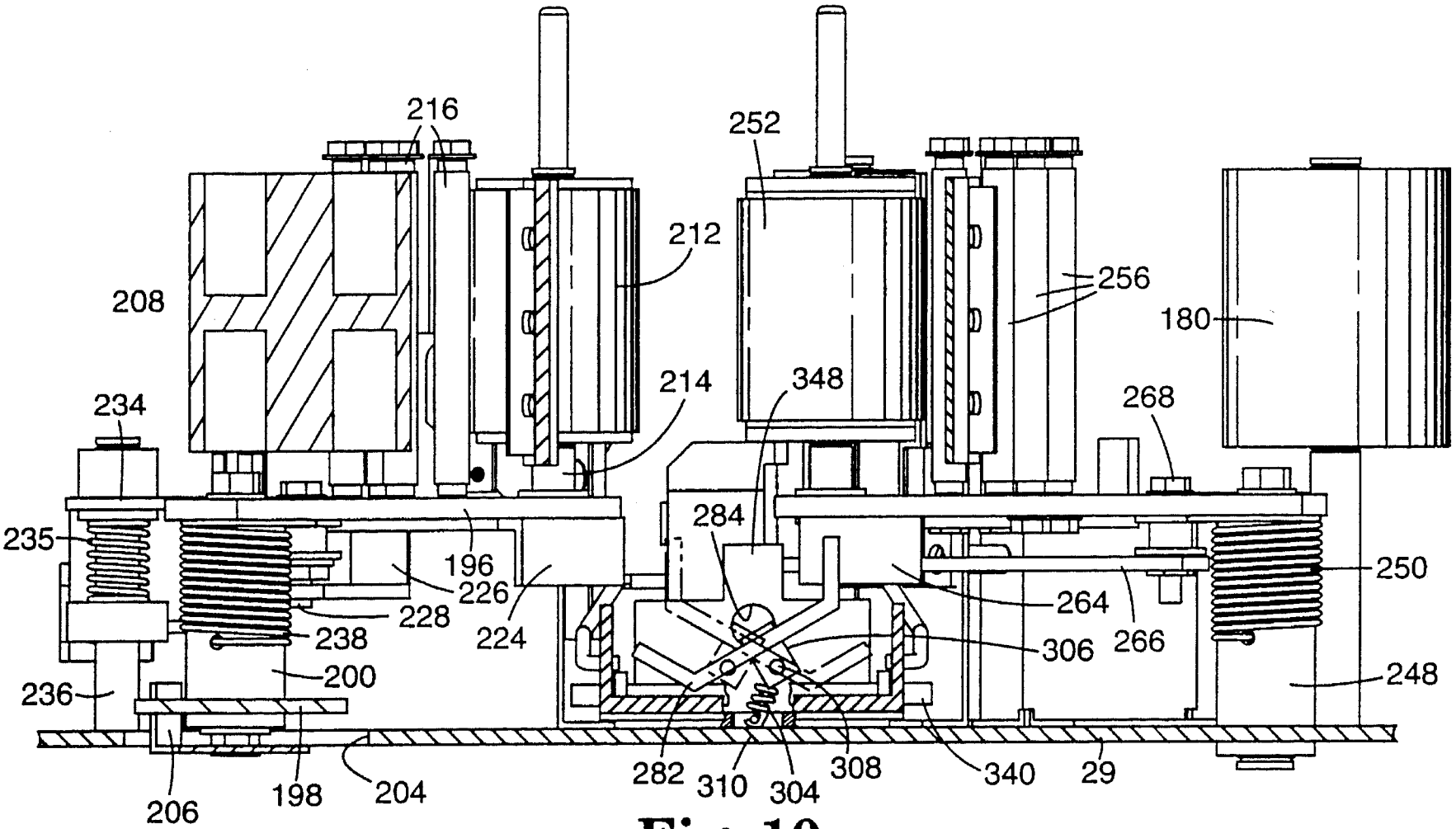
FIG. 10 is a cross-sectional view taken along line 10—10 in FIG. 7 illustrating the latching mechanism for selectively engaging the first or second lever mechanisms.

The first lever mechanism 182 includes an arm 196 pivotally connected to a link 198 at a pivotal connection 200. The link 198 is further pivotally supported on the support plate 29 by a pivot pin 202. As such, link 198, pivotal connection 200 and arm 196 are together pivotal about the pivot pin 202. Moreover, the arm 196 is pivotal about the connection 200 with respect to the link 198. The pivotal movement of link 198 is limited by a slot 204 provided in the support plate 29. Further in this regard, a stop element 206, see FIG. 10, is provided from the bottom of the pivotal connection 200 for abutting the side edges of the slot 204 and limiting the pivotal movement of the link 198. A freely rotatable roller 208 is also pivotally supported by the link 198 by a conventional axle 210.

Figure 11:
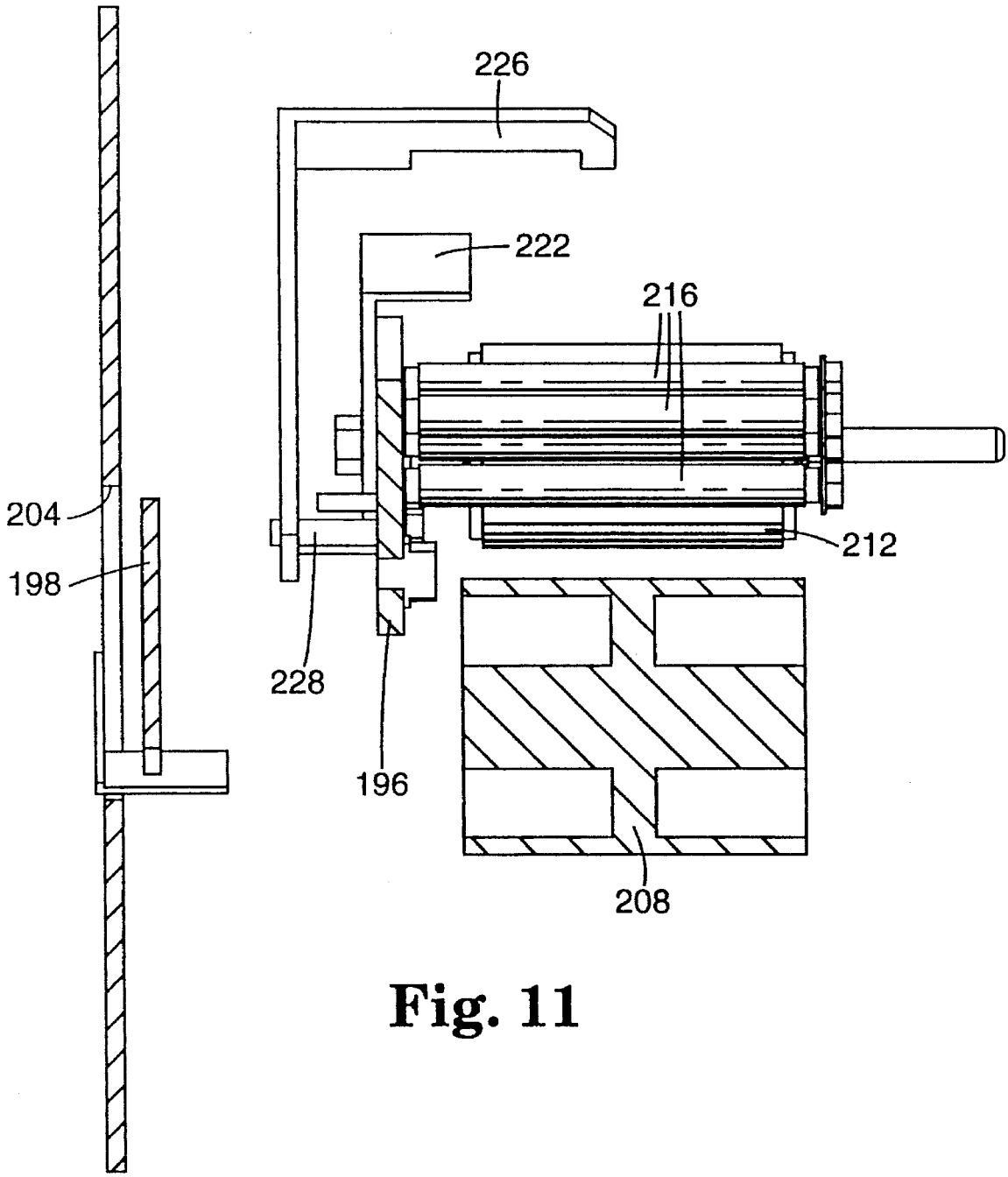
FIG. 11 is a cross-sectional view taken along line 11—11 in FIG. 7.

At the distal end of the arm 196, another freely rotatable roller 212 is supported by an axle 214. Intermediate of the roller 212 and the pivotal connection 200 on the arm 196, a plurality of small diameter freely rotatable guide rollers 216 are provided for guiding the tape from roller 208 to roller 212. A blade shield 218 is also attached to the arm 196 to cover the cutting edge 220 (see FIG. 14) of the first stationary blade 186 over the entire range of motion of the arm 196. Note that the blade shield is divided into two portions so that the tape can be easily threaded between the rollers 216 from roller 208 to roller 212. It is further noted that the blade shield 218 has been removed in FIGS. 8, 10 and 11 for clarity in illustration.

A catch 222 is further provided fixedly connected with the arm 196 for interaction with the first release mechanism 190. The catch 222 can be fixed to the lever 196 in any conventional manner to move with the arm 196 but not relative thereto, see FIG. 11. As seen in FIG. 10, a tab 224 is also provided depending downwardly and fixed to the arm 196 for interaction with the latching mechanism 194, as will be more fully described below. Again, the tab 224 moves with the arm 196 but is not relatively movable thereto. Lastly, a gripper arm 226 is pivotally connected to the arm 196 at a pivot point 228. The purpose of the gripper arm 226 will be more fully understood from the description of the operation below. The gripper arm 226, however, is also movable relative to the arm 196 about the pivot pin 228. Preferably, this pivot movement is controlled by a conventional frictional connection so that the gripper arm 226 is movable, but will be effectively held in any of its desired pivotal positions by a sufficient frictional force.

The first release mechanism 190 comprises a conventional solenoid 230 which is controlled between extended and retracted positions. The solenoid 230 includes a link 232 which is extendable and retractable as partially controlled by the solenoid 230 and is pivotally connected to a release latch 234 which is pivotally supported by the support base 29 at a conventional pivot pin 236. A torsion spring 235 acts about the pivot pin 236 to bias the release latch 234 to its capture position and to control the extension of the link 232. When the link 232 is in its extended position, the release latch 234 is pivoted about pin 236 to be in a position to latch with and capture the catch 222 fixed with the arm 196 of the first lever mechanism 182. When the solenoid is energized, the link 232 is retracted and the catch 222 is released from its capture with the release latch 234. The arm 196 is then movable about connection point 200 and pivot pin 202. It is also noted that the arm 196 is also preferably biased toward the release latch 234. To do this, torsion springs 238 and 240 are preferably provided about the connection point 200 and the pivot pin 202, respectively. Depending on the machine orientation, torsion springs 238 and 240 may together act in the counter-clockwise direction, as viewed in FIG. 7, or one or both may in the clockwise direction so long as the combination of the weight of the arm 196 and the bias of the torsion springs 238 and 240 result in the overall bias of the arm 196 toward the release latch 234. Moreover, it is preferable to select the bias of the springs 238 and 240 so as to not only urge the arm 196 toward the release latch 234, but also so that the nip pressure of roller 212 against roller 252, described below, is optimized. The energization and deenergization of the solenoid 230 will be more fully understood with the description of the electrical control schematic and the operation of the invention described below.

The first stationary blade 186 is fixedly mounted to the support plate 29 such as by conventional bolts 242. The first stationary blade 186 is positioned such that the cutting edge 220 (see FIG. 14) thereof is within the blade shield 218 and so that it passes between the rollers 216 to cut the tape threaded from roller 208 to roller 212 through rollers 216 as the arm 196 is moved clockwise as shown in FIG. 7 sufficiently. Again, the timing and activation of such cutting operation will be more fully understood from the description of the operation below. The stationary blade 186 also is preferably provided with a stop element 244 to limit the clockwise movement of the arm 196.

The second lever mechanism 184 is substantially similar to the first lever mechanism 182, except that its arm 246 is directly pivotally mounted to the supported plate 29 at a pivot pin 248 without an additional link. The pivot pin 248 also preferably includes a torsion spring 250 biasing the arm 246 toward the second release mechanism 192.

The arm 246 is provided with a roller 252 at its distal end freely rotatably supported by an axle 254. A plurality of guide rollers 256 are also provided intermediate of the roller 252 and the pivot pin 248. Again, the guide rollers guide tape passing over roller 180 rotatably mounted to the support plate 29 to the roller 252 pivotal with arm 246. A blade shield 258 is also preferably provided to cover a cutting edge 260 (see FIG. 14) of the second stationary blade 188 during the entire range of movement of the arm 246 about pivot pin 248. The blade shield 258 is also preferably divided into portions providing a slot through which the tape can be easily threaded from roller 180 to roller 252.

A catch 262 is also fixedly connected to move with the arm 246 about pivot pin 248 and for interaction with the second release mechanism 192. A tab 264, see FIG. 10, is also fixed to the arm 246 and depends downwardly therefrom to interact with the latching mechanism 194, described below. Lastly, a gripper arm 266 is pivotally connected with the arm 246 at a pivot point 268. Like the gripper arm 226, described above, a conventional frictional connection is preferably provided at the pivot point 268 so that the gripper arm 266 is freely rotatable there about, but is selectively held in desired positions by the frictional force at such connection.

The second release mechanism 192 is substantially the same as the first release mechanism 190 described above, and comprises a solenoid 270 provided with an extendable and retractable link 272. The link 272 is pivotally connected to a release latch 274 which is further pivotally supported on the support plate 29 by a pivot pin 276 and is biased toward its capture position by a torsion spring 275 acting about the pivot pin 276. When the release latch 274 is pivoted about the pivot pin 276 to its capture position under the bias of spring 275, it is positioned where it can capture the catch 262 fixed to rotate with the arm 246. Additionally, the link 272 is extended. When the solenoid 270 is energized, the link 272 is retracted and the release latch 274 is pivoted about the pin 276 to a release position. When in its release position, the arm 246 is movable about its pivot pin 248 without interference of the release latch 274.

The second stationary blade 188 is also conventionally mounted to the support plate 29 by conventional bolts 278. The second stationary blade 188 is positioned such that its cutting edge 260 (see FIG. 14) will cut the tape provided from roller 180 to roller 252 through guide rollers 256 as the arm 246 is sufficiently pivoted toward the cutting edge 260. The second stationary blade 188 further includes a stop 280 for limiting the pivotal movement of the arm 246 counter clockwise about pivot pin 248.

Figure 8:
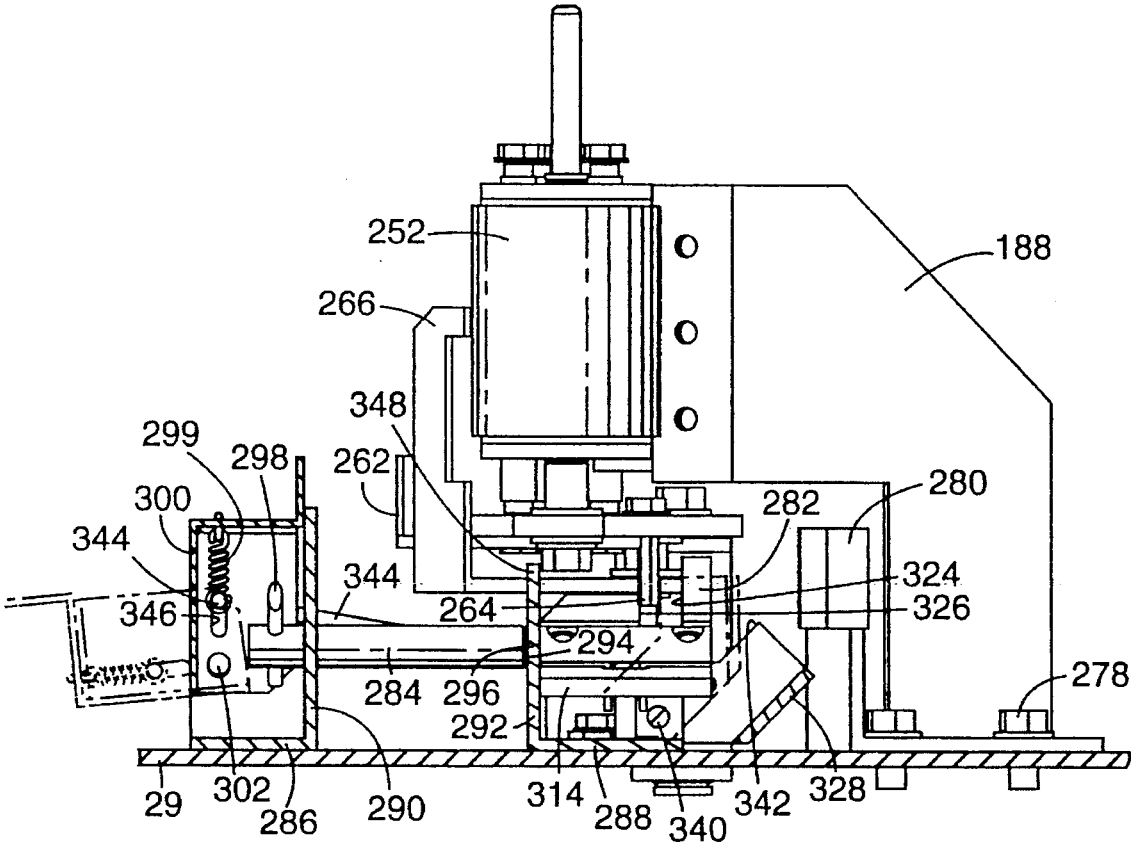
FIG. 8 is a cross-sectional view taken along line 8—8 in FIG. 7 showing a latching mechanism for selectively latching a first or second lever mechanism of the splicing station in accordance with the present invention.

The latching mechanism 194, as shown in FIGS. 7, 8, 10, 23, 25 and 29, comprises a latch 282 connected with a shaft 284 so that the latch 282 is selectively movable between two rotatable positions, see FIG. 10. As shown in FIG. 8, the shaft 284 is rotatably supported by a housing 286 and a bracket 288. In this regard, a wall 290 of the housing 286 is provided with an appropriate bearing surface for supporting the shaft 284. Likewise, a wall 292 of the bracket 288 is provided with a similar bearing surface. Preferably, the shaft 284 is axially fixed, such as by providing a thrust surface 294 on the shaft 284 to engage with the side surface of the wall 292 and a second thrust surface 296 provided at an edge of the latch 282 to also engage with the opposite surface of the wall 292 of the bracket 288.

An actuation element 298 is also preferably provided at the end of the shaft 284 within the housing 286 for manual manipulation of the shaft 284 to move the latch 282 between its two positions. Access to the actuation element 298 is governed by a door 300, see FIG. 8, which is pivotally connected to the housing 286 at the side walls thereof by a pivot shaft 302. In order to properly hold the latch 282 in either one of its positions, an over center compression spring 304 is provided connected between a downwardly extending boss 306 of the latch 282 and a lower wall of the bracket 288.

More specifically, the over center spring 304 is connected to a pin 308 provided within the boss 306 and a pin 310 in the lower wall of the bracket 288 directly below the shaft 284. The inherent resiliency within the spring 304 permits the boss 306 to move between the two positions. The compressive force of the over center spring 304 holds the latch 282 in either of its positions. When the actuation element 298 is manipulated, the resiliency of the spring 304 permits the boss 306 and thus the latch 282 to move to its other position.

Figure 23:
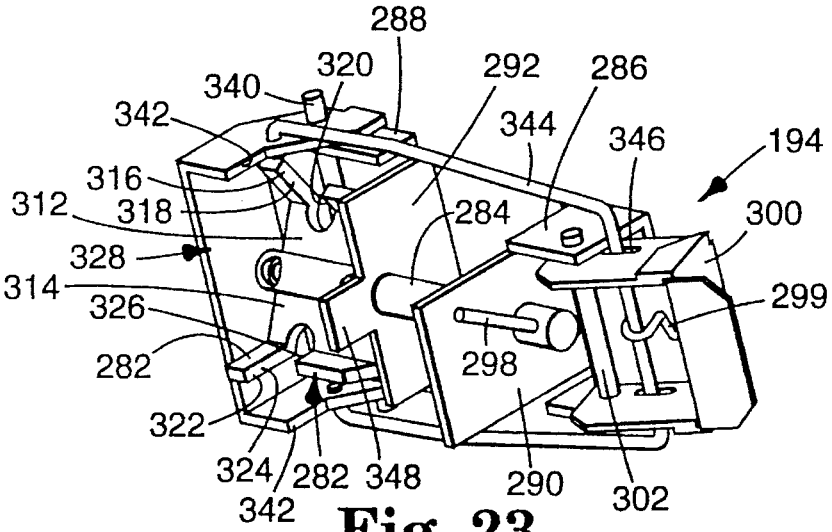

The latch 282, as shown in FIGS. 7 and 23, is divided by its connection to the shaft 284 into a first latch portion 312 and a second latch portion 314. A slot 316 further divides the first latch portion 312 and provides engagement edges 318 and 320 for receiving and engaging with the tab 224 of the arm 196 of the first lever mechanism 182. Similarly, the second latch portion 314 is divided by a slot 322 to define engagement edges 324 and 326. The engagement edges 324 and 326 are provided to engage with the tab 264 of the arm 246 of the second lever mechanism 184 when the latch 282 and arm 246 are positioned accordingly, as will be further described in the operation of the invention below.

Also pivotally connected to the bracket 288 is a disabler member 328 which is pivotally connected to the bracket 288 by a shaft 340. The disabler member 328 also includes engagement edges 342 for engagement with either of the tabs 224 or 264 of the first lever mechanism 182 or second lever mechanism 184, respectively, when the disabler member 328 is moved from its solid line position shown in FIG. 8 to its phantom position about shaft 340.

The disabler member 328 is further connected with the door 300 by a wire element 344. The wire element 344 engages within slots 346 in the side walls of the door 300 spaced from the pivot shaft 302 of the door 300 to the housing 286. A tension spring 299 urges the wire element 344 toward the top end of slots 346 as viewed in FIG. 8. Thus, when the door 300 is pivoted from its solid line position shown in FIG. 8 to its phantom position shown in FIG. 8, the disabler member 328 is pivoted about its shaft 340. The wire element 344 in conjunction with the spring 299 act as an over center spring mechanism which holds the door 300 in either of its two positions. In other words, the wire element 344 not only operatively connects the door 300 with the disabler member 328, its action against the slots 346 under the influence of spring 299 holds the door 300 in its respective positions on either side of the pivot shaft 302.

In order to facilitate setting up of either of tapes 42 or 44 in a ready splice position, the splicing station 34 further includes a first cutting station 350 and a second cutting station 352 located adjacent to the first lever mechanism 182 and the second lever mechanism 184, respectively. Also, an idler roller 354 is further provided conventional pivotally supported from the support plate 29 by an axle 356. As will be more fully described below, when setting up either of the first or second lever mechanisms 182 or 184 in a splicing ready position, it is important that the end of tape 42 or 44 be located properly just adjacent to roller 212 or 252, respectively. In order to do this, tape 42 or 44 is threaded over the roller 212 or 252 and then to the idler roller 354. This brings tape 42 or 44 adjacent either of the cutting stations 350 or 352 so that the tape 42 or 44 can be cut by the first or second cutting station 350 or 352 to precisely locate the end of tape 42 or 44 with respect to the roller 212 or 252. First cutting station 350 includes a guide bracket 358 and a sliding blade 360 slidably disposed on the guide bracket 358 so as to move across the transverse width of tape 42, see FIG. 2. A knob 362 is also provided connected with the sliding blade 360 for manual sliding of the blade 360 along the guide bracket 358. The cooperating slide and guide configuration between the sliding blade 360 and the guide bracket 358 can be any conventional slide and guide as long as the blade 360 moves across the total transverse width of the tape 42 when threaded between roller 212 and roller 354.

Figure 9:
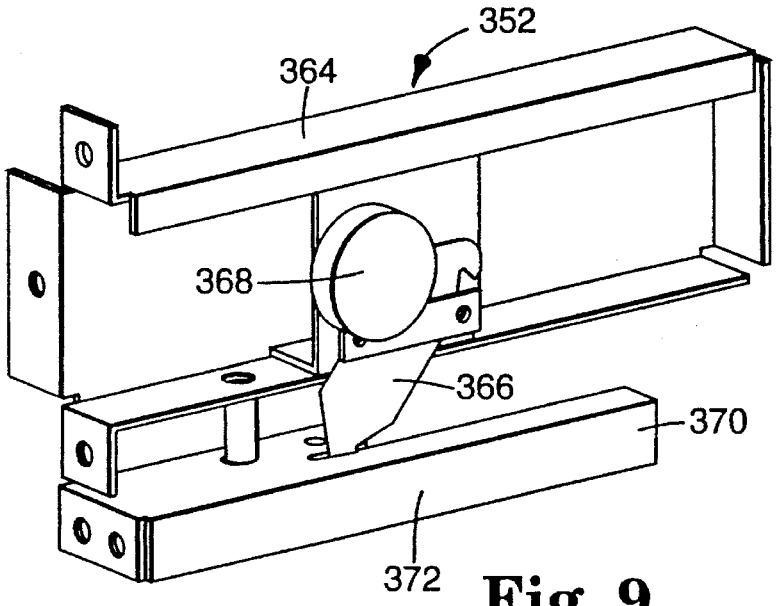
FIG. 9 is a perspective view of a cutting station shown removed from the support plate and that is provided as part of the splicing station in accordance with the present invention.

Similarly, the second cutting station 352 includes a guide bracket 364 and a sliding blade 366, see FIG. 9. A knob 368 is also provided for manual sliding of the blade 366 along the guide bracket 364. As above, any conventional slide and guide arrangement can be utilized as long as the blade 366 will cut the entire transverse width of the tape 44 when it is threaded over roller 252 to idler roller 354. As also shown in FIG. 9, a further blade guide 370 may be mounted to the support plate 29 adjacent to the guide bracket 364 including a slot 372 for receiving the cutting edge of the blade 366 when the blade 366 is in its non-use position.

Referring back to FIGS. 2 and 3, the tape drive station 36 will be described, the purpose of which is to drive either of the tapes 42 or 44 as they exit the splicing station 34 and from the continuous tape supply station 20 as supplied tape 24. Tape 42 or 44 leaves the splicing station 34 as guided by an idler roller 374 conventionally mounted to the support plate 29 by an axle 376. Thereafter, the tape is threaded over a series of idler rollers 378 and 380 also conventionally supported by the support plate 29 by axles 382 and 384, respectively. The rollers 378 and 380 guide the tape to a drive roller 386 which is driven by a motor 388. After the drive roller 386, the tape is threaded over another dancer roller 390 which is conventionally supported on an axle 392 to a dancer arm 394 that is further pivotally supported from the support plate 29 by a pivot pin 396, see FIG. 2. The dancer arm 394 is limited in its pivotal movement about the pin 396 by an upper stop 398 and a lower stop 400. Moreover, the dancer arm 394 is preferably biased towards its lower most position against the lower stop 400 by a tension spring 402 connected between the support plate 29 at 404 and the dancer arm 394 at point 406 located on the other side of the pivot pin 396 than the dancer roller 390.

The tape 24 or 44 is then guided for exit from the continuous supply station 20 to become the supplied tape 24 by way of yet another series of idler rollers 408, 410, 412 and 414 conventionally supported to the support plate 29 by axles 416, 418, 420 and 422, respectively. It is understood that more or less of such idler rollers may be utilized for proper guiding of the tape. Note also that roller 414 is supported by axle 422 outside of the support plate 29, and is preferably in fact connected by way of a bracket 424 to a side wall 426 that is fixed with the support plate 29.

The arrangement of the drive roller 386 with respect to the guiding rollers 378 and 380 and the dancer roller 390 advantageously provide a backside drive system which drives the non-adhesive backside of either tape 42 or 44 through the tape drive station 36. Such an arrangement is advantageous in that the drive roller 386 need not be specifically treated to release from adhesive of the adhesive side of the tape as is typically done. However, it is important that the friction between the drive roller 386 and the backside of the tape be sufficient as controlled by the surface area of contact, the material of the roller 386 and the tape, and the angle of wrap of the tape about the drive roller 386. As shown, preferably the tape wraps about the drive roller 386 by about 270°, and the roller 386 if preferably composed of urethane which is effective against typical box sealing tapes that comprise a backing of polypropylene.

The drive roller 386 is conventionally connected with the motor 388 by way of a conventional gear box 428. The gear box 428, motor 388 and drive roller 386 are together preferably supported by the support plate 29, such as by a bracket 430 conventionally connected between the gear box 428 and the support plate 29. The motor 388 is preferably a direct current motor, such as that made by the Bodine Company of Chicago, Ill. and commercially available as motor number 32D5BEPM-5F. The motor 388 is preferably further controlled by a motor controller, such as that which is commercially available from the Powr-ups Company of Shirley, N.Y. as Model Number 2749. The motor controller preferably is a regenerative controller which is capable of applying a reverse electomotive force to the motor 388 for braking the motor 388 and thus the drive roller 386, as will be more fully explained with reference to the electrical schematic below.

Furthermore, it is an important function of the motor 388 and motor controller thereof to control the tape tension consistently and at the appropriate tension as it exits the continuous tape supply station 20. The motor 388 and controller do this with the help of the dancer arm 394 and a dancer position sensor 432 mounted to the support plate 29 adjacent to the dancer arm 394. It is the function of the dancer position sensor 432 to relay the position of the dancer arm 394 to the controller so as to speed up, slow down or stop the motor 388 and thus the drive roller 386.

The dancer arm 394 moves upwardly in response to an increase in tension of the tape 24 as it is demanded. When the dancer arm 394 is at its lowermost position toward the stop 400, there is no demand (zero tension) for tape 24 and the motor 388 is not driven. As demand begins, the dancer arm 394 is raised according to the acceleration of the tape 24. This action must cause the motor to accelerate the drive roller 386 so as to,drive the tape 24 at a substantially consistent and appropriate tension. When the demand for tape 24 is constant, the dancer arm 394 settles at an equilibrium position (somewhere between the upper and lower extremes) which then drives the drive roller 386 at a constant speed. When demand is reduced or ceased, the dancer arm 394 moves back downwardly under the influence of spring 402 and a torsion spring 434 provided to act about the pivot pin 396, see FIG. 12. The motor speed must be reduced accordingly to maintain the desired consistent tension. During the slowing operation of the drive roller, it may be necessary to additionally brake the motor 388 especially if there is a sudden decrease or stoppage in demand.

As described above in the Background section, box taping machines have in common that the tape is demanded intermittently. In other words, tape is demanded from its supply as a length of tape is applied to one of such boxes or cartons by a tape applicator, and then the tape demand is stopped for a moment until the next box is positioned relative to the tape applicator for the next application. Moreover, the indexing demand of such box taping machines is characterized generally as a square wave representing an immediate demand upon the start of application of tape to a box up to the level (rate) of demand that is then substantially constant during the application of the tape length to the box until demand is ceased immediately upon the cutting of the length of tape from its supply roll. At higher tape speeds, such an indexing demand requires a highly responsive motor control system to keep the tape tension substantially consistent.

Figure 12:
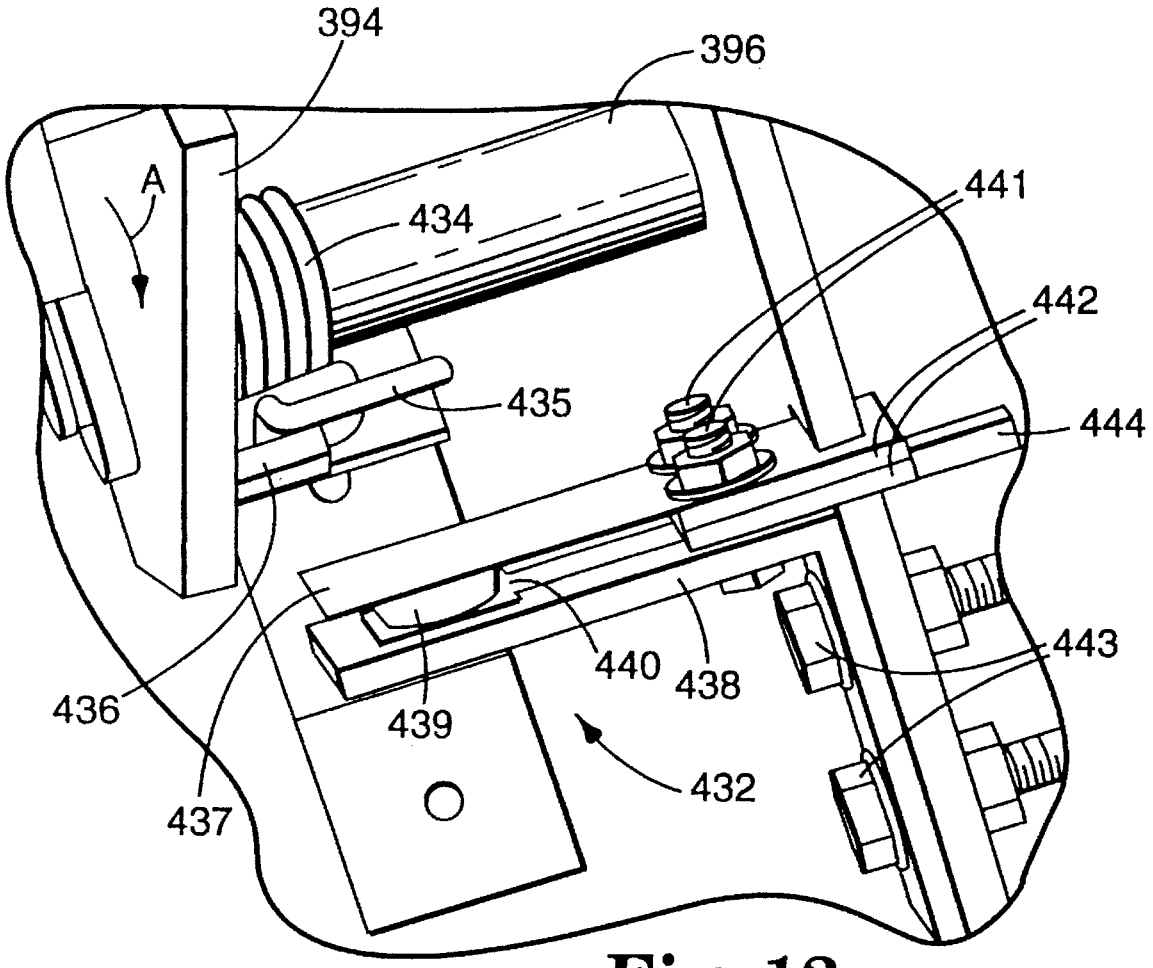
FIG. 12 is an enlarged view taken from FIG. 3 of a tension controlling dancer arm and a position sensing device for controlling the drive motor in accordance with the position of the dancer arm.

Preferably, the torsion spring 434 is provided about the pivot pin 396 having one end thereof (not shown) relatively fixed to the dancer arm 394, and the other end 435 thereof positioned against a stop element 436, see FIG. 12, so as to bias the dancer arm 394 in the same direction as spring 402. The end 435 of the torsion spring 434 preferably further extends toward the support plate 29 to provide an abutment portion thereof which will engage with the dancer position sensor 432 when the dancer arm 394 is rotated upward about its pivot pin 396, that is in the direction of arrow A of FIG. 12.

It is understood that the dancer position sensor 432 may comprise any conventional proximity switch or electrical sensing device which relates the dancer arm position and thus the demanded tape tension to the motor controller for controlling the motor speed and thus the tape tension as it exits the station 20.

Preferably, the dancer position sensor 432 comprises a force sensing device made up of a flexible plate 437, a rigid bracket 438, a bumper pad 439 and a force sensing device 440. the flexible plate 437 preferably comprises a piece of spring steel which is connected with the rigid bracket 438 by bolts 441 but is spaced from the rigid bracket 438 by spacer elements 442. The rigid bracket 438 is conventionally connected to the support plate 29, such as by bolts 443. The bumper pad 439 is connected to a surface of the flexible plate 437 facing the bracket 438 within the defined space and is positioned to contact the force sensing device 440 which is connected to the facing surface of the bracket 438 such as by a conventional adhesive. The space between the flexible plate 437 and the bracket 438 is preferably defined by the spacer elements 442 so that the bumper pad just contacts or very nearly contacts the force sensing device 440. An electrical connector 444 is also preferably provided from the back end of the dancer position sensor 432 to provide an electrical connection from the force sensing device 440 to a wire further connected with the motor controller.

The force sensing device 440 preferably comprises a semi-conducting polymer laminated over a conductive grid that responds, i.e., changes resistance, to an applied force. Such a force sensing device is commercially available as an Interlink FSR™ model 501C force sensing device. More specifically, as the force applied to such a force sensing device 440 is increased or decreased, a proportional change in the force sensing device resistance occurs. The force sensing device 440 is further configured in a voltage divider that converts the resistance thereof into a voltage signal which is supplied to the motor controller for controlling motor speed.

Figure 30:
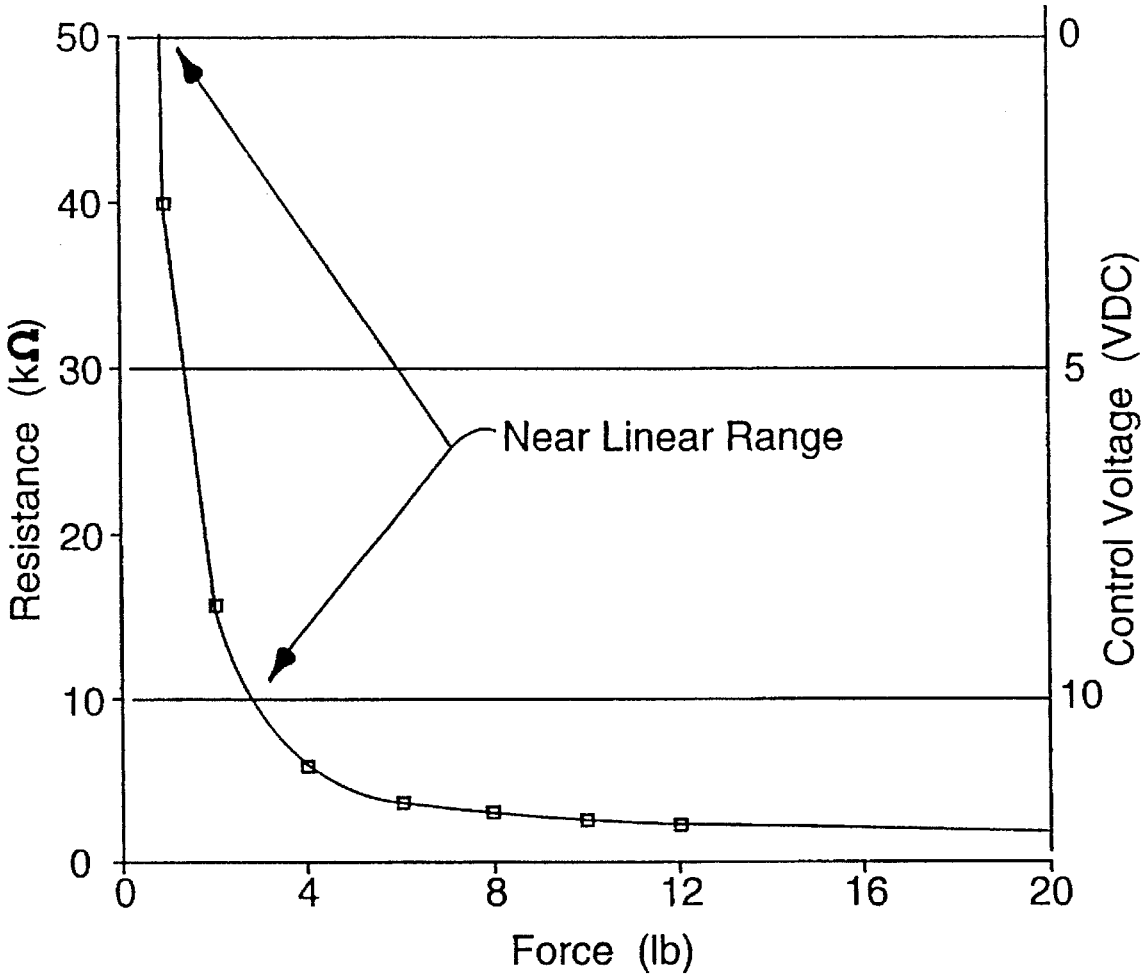
FIG. 30 is a graph of Force vs. Resistance and Control Voltage in accordance with a force sensing device used as a position sensor in the present invention.

With reference to FIG. 30, a graph of force vs. resistance and control voltage illustrates how an increase in force results in a decrease in resistance which is converted to an increase in control voltage. In the approximate force range of between 0.87 and 2.83 lbs, resistances occur nearly lineraly of between 50 and 10 kΩ. The dancer position sensor 432 preferably operates within this near linear range so that the increase in force produces a substantially proportional change in resistance. Furthermore, the control voltage varies substantially within this same range from a zero control voltage to 10 volts. At zero voltage, the motor 388 is controlled off. When a 10 volt signal is sent to the motor controller, the motor is run at full speed.

The dancer position sensor 432 is positioned on the support plate 29 relative to the dancer arm 394 so that upon pivotal movement of the dancer arm 394 from its lowermost position against stop 400 the end 435 of the torsion spring 434 will abut the flexible plate 437, and as the pivotal movement continues the force applied against the flexible plate 437 by the end 435 will increase. Note that the end 435 comes off of the stop 436 as the dancer arm 394 is raised. The amount of force applied is a function of the position of the dancer arm 394. The force is transferred from the flexible plate 437 to the force sensing device 440 by way of the bumper pad 439. Thus, the voltage signal outputted from the force sensing device 440 is also a function of the dancer arm position. Preferably, the dancer arm 394 has a range of movement of about 66° and the end 435 of the torsion spring 434 first abuts the dancer position sensor 432 at about 20° up from the lowermost position of the dancer arm 394.

The effect is a closed loop system that feeds the tape at essentially constant tensions for a wide range of demand profiles. The force sensing device approach advantageously achieves a smoother operation than with conventional proximity switches and does not have the relatively short service life associated with devices such as potentiometers. Again, this is because the voltage output varies essentially linearly with respect to the force applied to the force sensing device.

Figure 13:
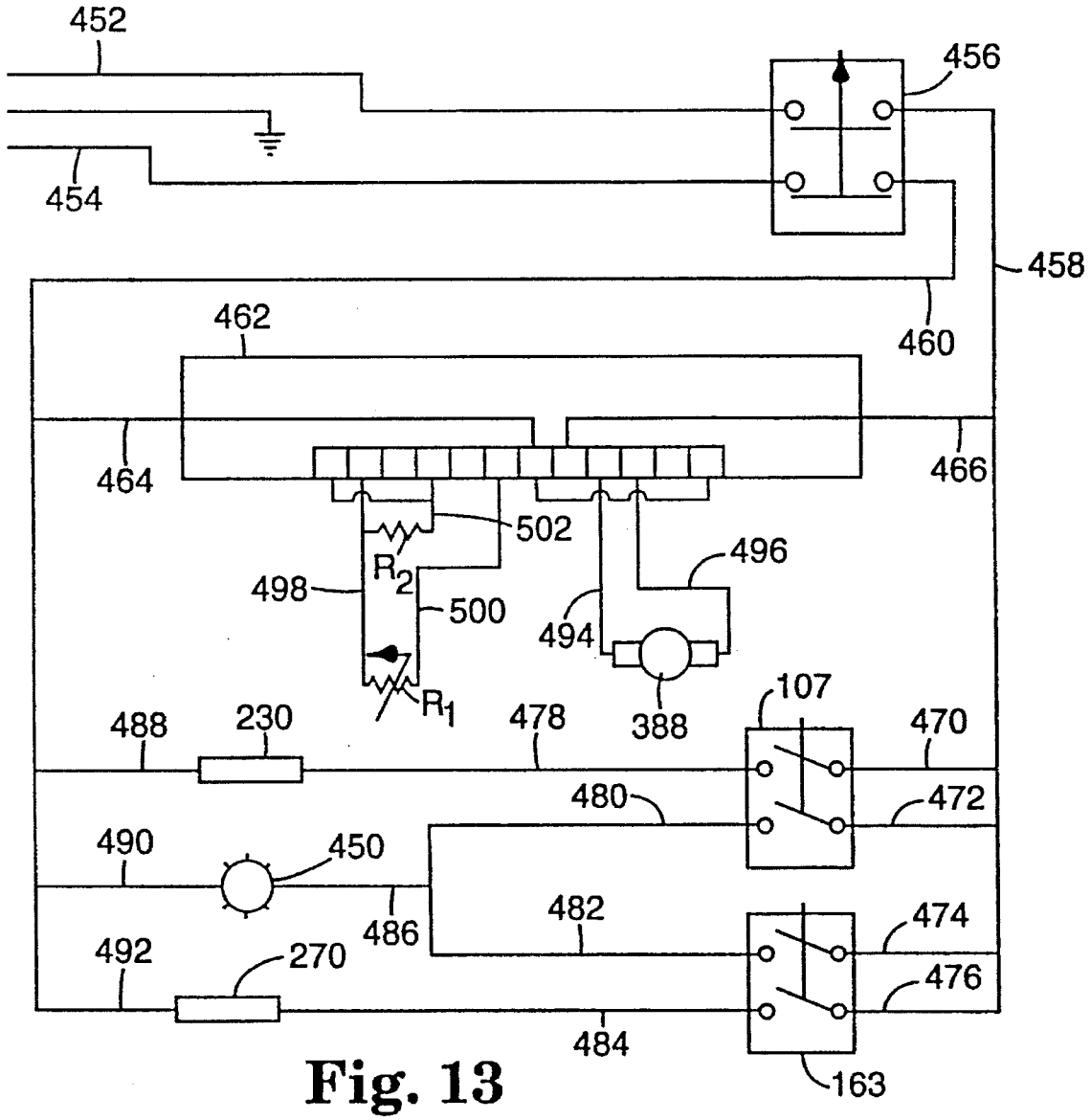
FIG. 13 is a schematic diagram of the electrical circuit for controlling the motor drive with a regenerative controller and activation and deactivation of the splicing mechanism of the present invention.

A schematic diagram of the electrical circuit used for controlling the motor 388, the first solenoid 230, the solenoid 270 and an indicator light 450, see FIG. 1, is illustrated in FIG. 13. Specifically, AC voltage is supplied by lines 452 and 454. A main power switch 456 comprises a double pole two position switch for connecting lines 452 and 454 to lines 458 and 460, respectively when the switch 456 is positioned to an on position. The motor controller 462, the first solenoid 230, the splice light 450, and the second solenoid 270 are connected in parallel to lines 458 and 460.

The microswitch 107 of the first roll unwind station 30 and the second microswitch 163 of the second roll unwind station 32 each comprise a two position double pole microswitch. Microswitch 107, when actuated, connects lines 470 and 472 to lines 478 and 480, respectively. Microswitch 163, when actuated, connects lines 474 and 476 to lines 482 and 484, respectively. Line 478 further connects with the first solenoid 230, lines 480 and 482 join together at line 486 which is connected to the splice light 450, and line 484 connects with the second solenoid 270. The line 460 is connected with the first solenoid 230, the splice light 450, and the second solenoid 270, respectively, by lines 488, 490 and 492.

When the first microswitch 107 is actuated, lines 470 and 472 are connected with lines 478 and 480 to thereby energize the first solenoid 230 and the splice light 450 thereby indicating that a splice is occurring. As described above, the first microswitch 107 is actuated when the first roll of tape 38 is sufficiently depleted and it is desired to switch to the second tape roll 40. Likewise, the second microswitch 163, when actuated, connects lines 474 and 476 with lines 482 and 484, respectively, to energize the splice light 450 and the second solenoid 270. The second microswitch 163 is actuated when the second roll of tape 40 is sufficiently depleted that it is desired to switch to a first roll of tape 38.

Power is supplied to the motor controller 462 via lines 464 and 466. The motor controller 462 is then connected to the motor 388 by lines 494 and 496 from the appropriate motor controller terminals. The motor controller 462 determines when and how much power is supplied to the motor 388 in accordance with the position of the dancer arm 394, described above. The position of the dancer arm 394 is sensed by the dancer position sensor 432 including the force sensing device 440 which is indicated in the schematic diagram as a variable resistor $R_1$ connected to the motor controller 462 by lines 498 and 500. A fixed resistor $R_2$ is also connected to the motor controller 462 by lines 498 and 502. It is the change in the ratio of the fixed resistor over the sum of the fixed resistor and the variable resistor (the force sensing device), $R_2/(R_1+R_2)$, that determines the control voltage.

Figure 13A:
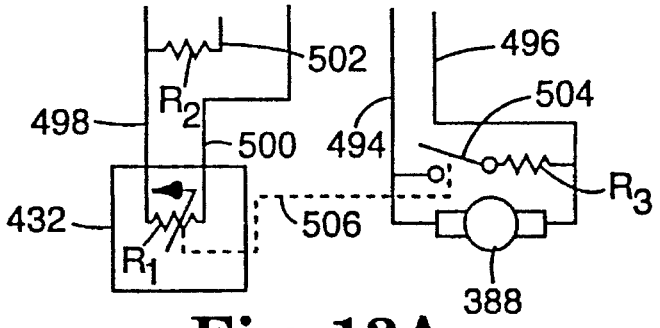
FIG. 13A is a schematic diagram of a partial electrical circuit for providing a dynamic brake to control the drive motor with a non-regenerative controller.

Referring now to FIG. 13A, a partial electrical circuit is illustrated wherein the force sensing resistor comprising the dancer position sensor 432, described above, is advantageously utilized not only to control the motor speed of motor 388, but also to act as a dynamic brake. When utilizing a regenerative type controller as the motor controller 462, described above, the motor controller 462 supplies a reverse electromotive force to the motor 388 when it is necessary to brake the motor 388. With a dynamic brake, the motor controller 462 can advantageously comprise a non-regenerative type controller.

The diagram of FIG. 13A fits within the diagram of FIG. 13 directly below the motor controller 462 and can be substituted for that of FIG. 13 by connection to the motor controller 462 by lines 494, 496, 498, 500 and 502 in the same way. Resistors $R_1$ and $R_2$ operate in the same way to determine the control voltage used to control the speed of motor 388. The motor 388 is also similarly connected to the motor controller 462 by lines 494 and 496; however, lines 494 and 496 are further connected in parallel to the motor 388 by a switch 504 and a third resistor $R_3$. The switch 504 is preferably mechanically connected, as indicated by dashed line 506, to a modified dancer position sensor 432' within which is the variable resistor $R_1$. When the control voltage is zero, the switch 504 is closed. If the motor 388 is running with switch 504 closed, it generates an electrical current which is directed through the resistor $R_3$ to the sink side of the motor 388 thereby creating the condition for reversing the motor and thus a dynamic braking effect is provided against the motor 388.

Figure 12A:
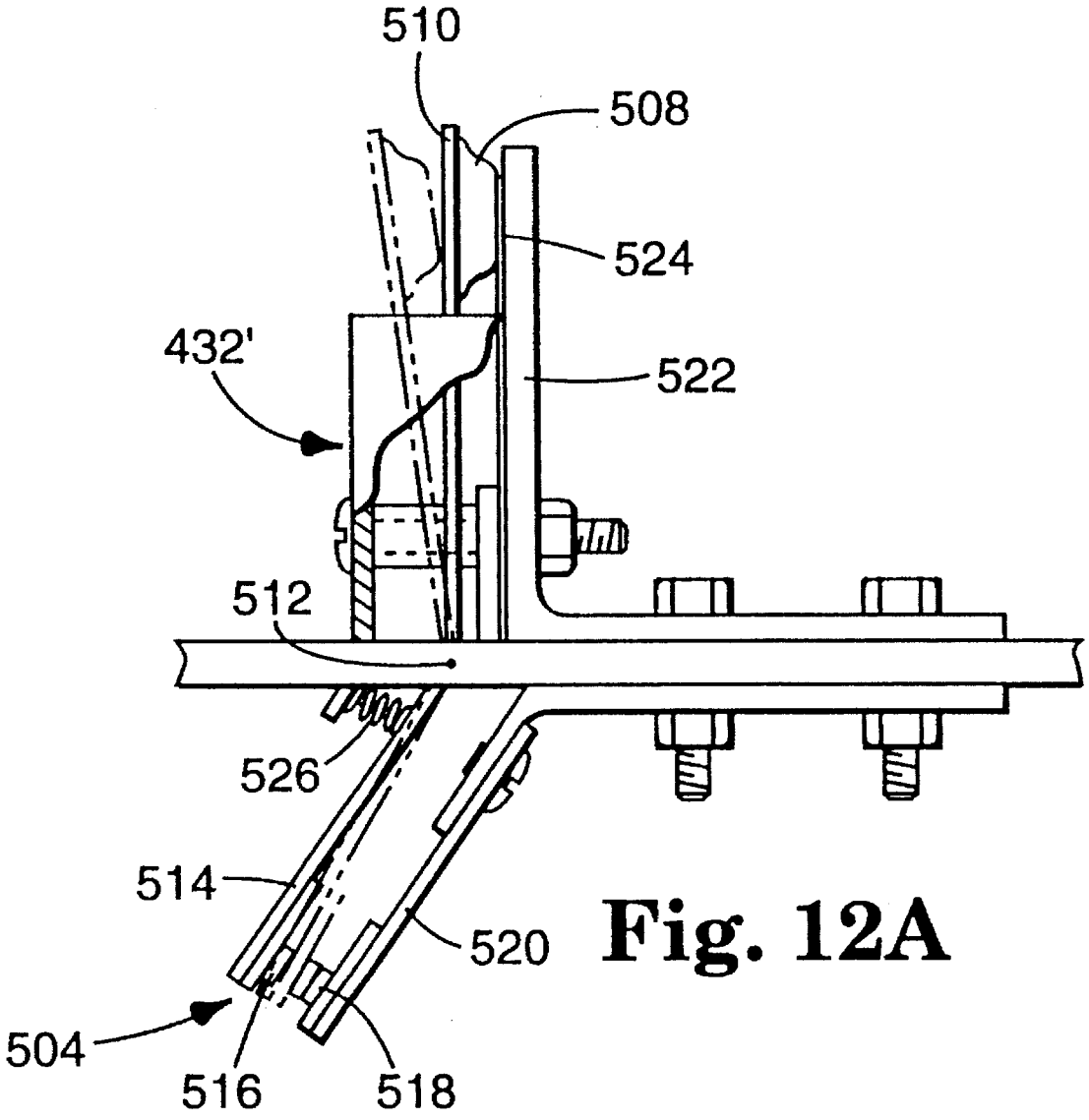
FIG. 12A is a cross-sectional view taken through the support plate of an alternative position sensing device including a dynamic brake switch for controlling the drive motor in accordance with the dancer arm.

Referring to FIG. 12A, the switch 504 and its connection to the dancer position sensor 432' are illustrated. The position of the dancer position sensor 432' on the support plate relative to the dancer arm 394 and the basic operation of the position sensor are the same as that of the position sensor 432 described above. However, a bumper pad 508 is mounted on a surface of a swinging plate 510 instead of a flexible plate. The swinging plate 510 is pivotally supported on the support plate 29 by an axle 512 mounted within a slot (not shown) through the support plate 29 and further includes a second swinging arm 514 that extends from the opposite side of the support plate 29. The second swinging arm 514 includes an electrical contact 516 on a face thereof so as to be able to contact an electrical contact 518 provided on a fixed bracket 520, and it is these elements that together comprise the stitch 504. A rigid bracket 522 is also conventionally mounted to the support plate 29 and is provided with a force sensing device 524 on its surface facing the bumper pad 508 in the same manner as that of the dancer position sensor 432 described above. The swinging plate 510 and second swing arm 514 are biased by a compression spring 526 so that the electrical contact 516 is normally held against the electrical contact 5 18, which activates the dynamic brake, described above.

In the same manner as that described above, when the dancer arm 394 is at its lowermost position, the end 435 of the torsion spring 434 does not apply a force against the dancer position sensor 432'. When the dancer arm 394 i s raised by the desired degree, the end 435 will contact the back surface of the swinging plate 510 which will immediately break the contact between electrical contacts 516 and 518 and will move the bumper pad against the force sensing device 524. Continued force will control motor speed as described above. At the breaking of the electrical contacts 516 and 518, switch 504 is deactuated and the dynamic brake is deactivated. Only then when the end 435 permits the swinging plate 510 to pivot sufficiently, will the dynamic brake again be activated by the reconnection of the switch 504.

A preferred embodiment of a continuous tape supply station has now been described including the basic components of a first unwind station 30, a second unwind station 32, a splicing station 34 and a tape drive station 36. This particular embodiment is specifically designed to handle high tape application speeds of 200 ft/min (61 m/min) under indexing demand situations described above. Under any indexing demand situation, the continuous tape supply station must have a particular capacity to effectively control the tape demand under a relatively consistent tension, the capacity being dependent on the particular situation. Such capacity is a function of the mass of the tape roll 38 or 40, the tape speed and the tape tension.

Moreover, the total tension control including the capacity can be made up in the supply station by the accumulation of the drive motor 388, the first dancer arm 64 and brake 54 combination (or the dancer arm 130 and brake 123 combination for tape roll 40), and the motor controlling dancer arm 394. More specifically, it is the amount of tape within the loops of the dancer arms 64 (or 130) and 394 that preferably define the machine capacity and which combined with the motor drive and brake systems define the tension control of the machine. It is understood that the size of one or more of the loops or the motor drive can compensate for the other. In other words, the tension control and capacity could be provided by any one of the variables or any combination thereof. For example, a decrease in motor drive (even to zero) would require an increase in loop size formed by one of the dancer arms. It is noted that loop size can be provided by utilizing more that one loop on a single dancer assembly. It has also been found that loop size requirements depend on whether the loop is formed operationally before or after the motor. In fact, it has been found that a loop formed after the motor must be about twice as large as a loop formed before the motor to have the same effect.

If tape speed or roll mass is decreased, the capacity is likewise decreased. However, if a lower tape tension is required, the capacity is increased. Thus, it can be seen that under low speed requirements or where the tape tension is required to be relatively high, a minimum of capacity is required. In high speed applications where a relatively low tape tension is required, such as the above described preferred embodiment is design for, greater tension control is required including a rather large capacity, which justifies the combination of motor drive and two dancer arms utilized by the preferred embodiment. Moreover, the preferred embodiment of the present invention is designed to minimize space requirements.

With reference to the Background section of the present application, the preferred embodiment comprises an "on the fly" splicing mechanism. That is, the splice occurs while the tape is moving. It is further understood that a "zero speed" splicing mechanism could be used. However, with a zero speed mechanism, some capacity of the tape is required after the splicing station so that tape can be demanded from that capacity while the splice occurs. This capacity would of course contribute to the total capacity of the supply station, discussed just above. Moreover, it is preferable that since the capacity is required after the splicing station, that the total necessary capacity be provided there. This would permit the use of a simpler and less expensive roll unwind control, such as a friction brake. In any case, the presence of any splicing station further requires that the tape be guided through such station and consistently controlled therethrough (particularly with respect to tension) so that consistent and effective splices are made. In the case of an on the fly splicing mechanism, it is preferable that some controlling capacity be provided before the splicing station to eliminate roll inertia before the splicing station. The total capacity could thus be provided before the splicing station.

A detailed description of the operation of the preferred embodiment of the present invention follows with reference to FIGS. 3 and 14–29. It is noted that FIG. 3 illustrates an entire continuous tape supply station 20 while FIGS. 14–29 illustrate a sequence of significant events of the splicing station 34 for a single splice and changeover operation from the first roll of tape 38 to the second roll of tape 40. As shown in FIG. 3, the first tape roll 38 is nearing depletion and the stripper roller 96 is riding closer to the core of the tape roll 38. When the stripper roller 96 gets near enough to the core, the cam element 104 depending from the stripper arm 92 will actuate the microswitch 107 of the limit switch 106, which will energize the first solenoid 230 and the splice light 450, as described above with regard to the schematic diagram of the electrical circuit. Moreover, while tape 42 is being demanded from the first tape roll 38, the dancer arm 64 moves up and down to control tape tension and to control the action of the band brake 54 against the brake drum 48, as described above. When tape 42 is demanded, the dancer arm 64 initially moves upward which releases the band brake 54 from the brake drum 48 and allows a quantity of tape to be stripped from the first tape roll 38. As the demand diminishes, the dancer arm 64 moves downwardly under the influence of the spring bias of spring 76 to gradually slow the first tape roll 38 and brake it.

At the time, the second tape roll 40 is a freshly supplied roll which has been threaded over the stripper roller 152 a dancer roller 134 and to the splicing station 34. The cam element depending downwardly from the stripper arm 148 will activate the microswitch 163 when the tape roll 40 is sufficiently depleted in the same manner as that described above with regard to the first unwind station 30. The dancer arm 130 functions in the same way as the dancer arm 64 described above to control the band brake 123 and brake drum 120 of the second unwind station 32.

Moreover, whenever tape 24 is demanded from the continuous tape supply station 20, the motor 388 drives the backside of tape 42 or 44 in a manner to control the tension of the tape 24 from the continuous tape supply station 20 as controlled by the motor controller 462 in accordance with the position of the dancer arm 394 as signalled thereto from the dancer position sensor 432.

Figure 14:
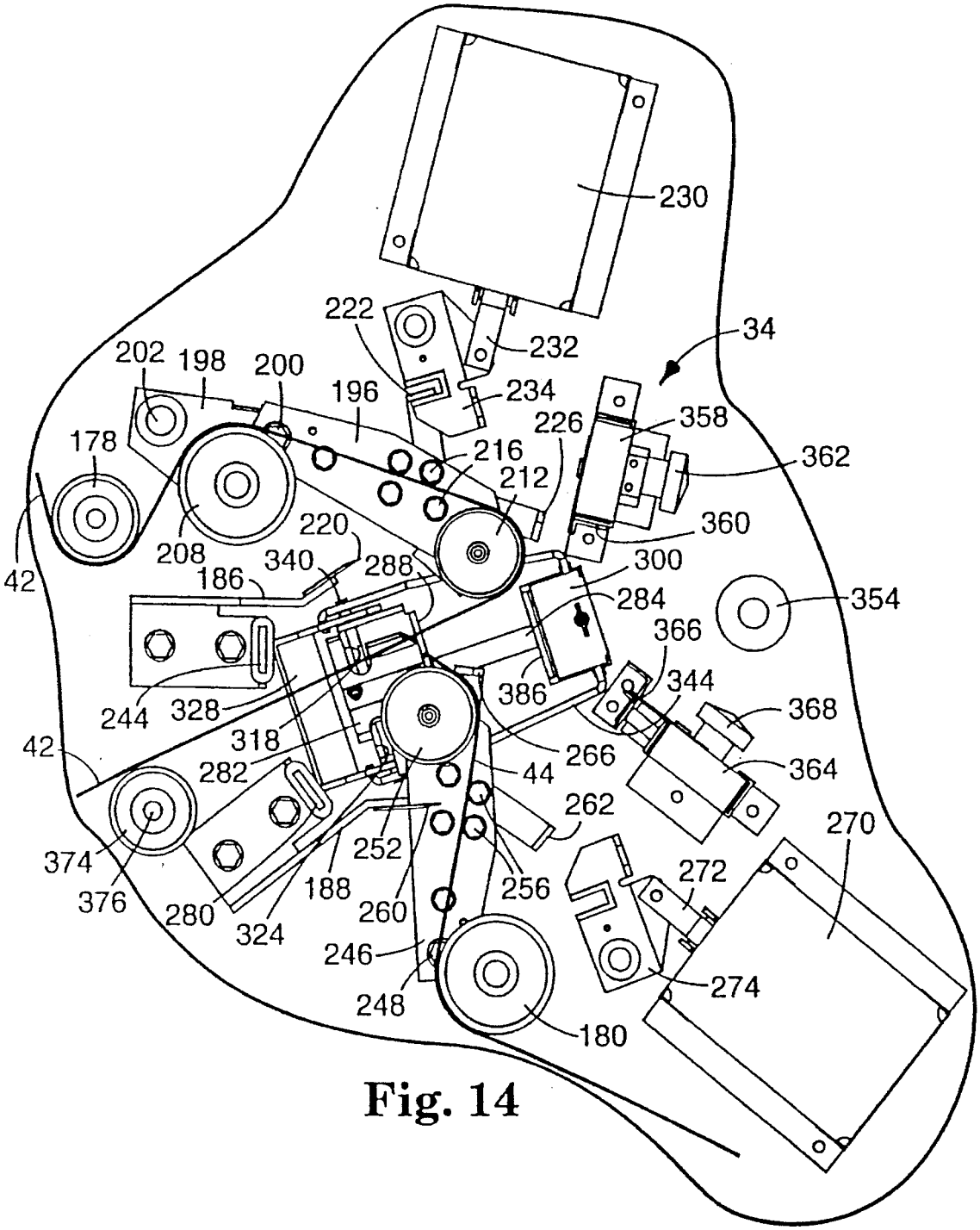
FIG. 14–29 illustrate the sequence of events for the effectuation of a splice and the changeover from one roll of tape to another through the splicing station of the present invention shown with the blade shields removed for clarity.

The splicing station 34 as illustrated in FIG. 14 corresponds to that of FIG. 3 where tape 42 is being demanded from the first tape roll 38 while tape 44 is in a ready position for splicing when the microswitch 107 is triggered and the solenoid 230 is energized. Note that in FIGS. 14–29, the blade shields 218 and 258 have been removed for clarity of operation.

In the FIG. 13 position, both solenoids 230 and 270 are deenergized since the microswitches 107 and 163 are both open. Thus, both links 232 and 272 are extended under the spring bias of the release latches and the release latches 234 and 274 are in position to capture the catches 222 and 262 fixed with the arms 196 and 246, respectively. However, with the tape 42 running through the splicing station 34 and with the tape 44 in a ready position for splicing, only the arm 196 is in its latched position with the catch 222 engaged within the release latch 234. Arm 246 is positioned forwardly and is held in place in that position by the latch 282. More specifically, the latch 282 is positioned in the solid line position of FIG. 10 with the tab 264 located within the slot 322 of the latch 282. The torsion spring 250 about pivot pin 248 biases the arm 246 such that the tab 264 is engaged with the short engagement edge 326 of the second latch portion 314 of latch 282, see also FIG. 23. Note that the end of tape 44 preferably extends slightly from the roller 252 of the arm 246 so that it is positioned for an easy pickup by the tape 42 during a splice. It is also noted at this point that the adhesive side of the tape 42 faces the tape 44 for adhering to the non-adhesive side of the tape 44 during a splice. The gripper 266 of the arm 246 has been manipulated to hold the tape 44 against the roller 252. Additionally, the door 300 is in its closed position and the disabler member 328 is pivoted to its nonuse position.

Figure 15:
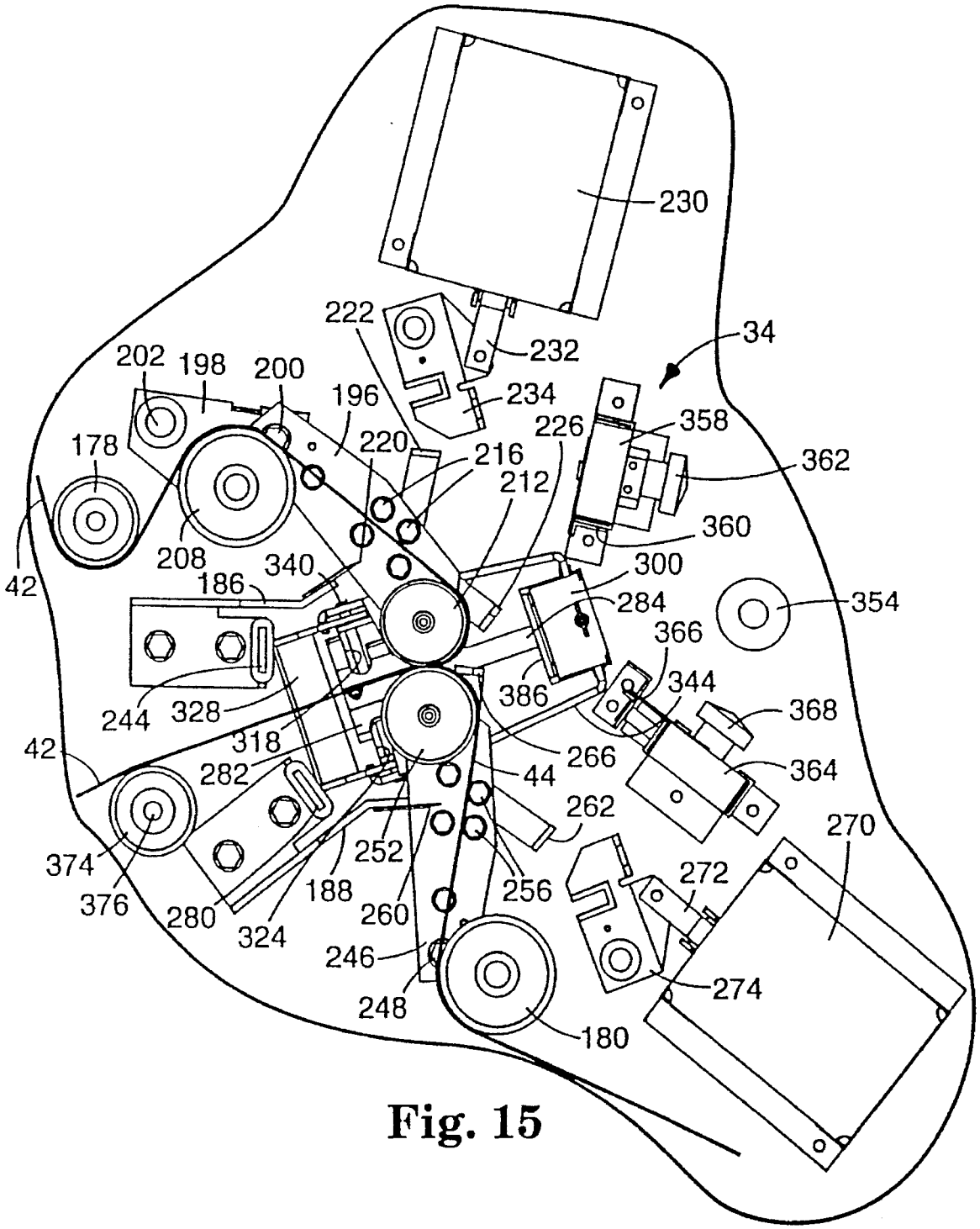
Figure 16:
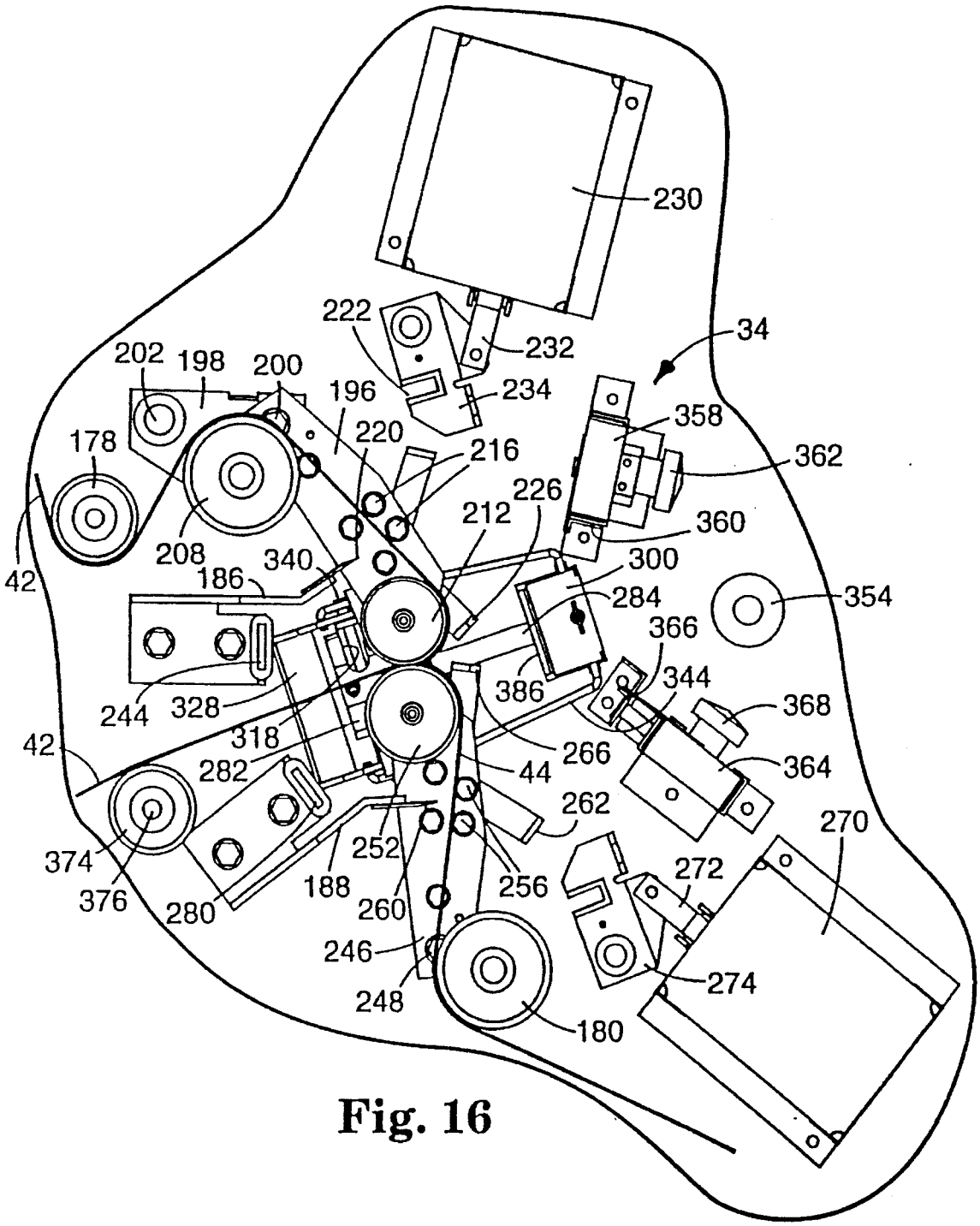

FIG. 15 illustrates the beginning of a splicing operation which occurs immediately after the first solenoid 230 is energized by the microswitch 107 which has sensed the appropriate time for a splice. The energization of the solenoid 230 retracts the link 232 and releases the catch 222 from the pivoted release latch 234. As a result of the continued demand for the tape 42, arm 196 is pivoted about pin 200 against the bias of torsion spring 238. The link 198 is preferably held in its position with stop 206 against the slot 204 of plate 29 by an opposite bias of torsion spring 240 and the weight of arm 196 and link 198.

Additionally, roller 212 comes in contact with roller 252 of arm 246 and the upper surface of tape 44 is adhered to the adhesive side of tape 42. At this point, the other elements of the splicing station 34 remain as described above with reference to FIG. 14.

Continued demand for tape 42 causes both rollers 212 and 252 to be moved forwardly together by a short distance until the tab 264 abuts against the longer engagement edge 324 of the latch 282 which prevents further forward travel of the arm 246. In other words, roller 252 is moved further forwardly by approximately the width of the slot 322. It is noted that the roller 212 is permitted to move forwardly because of the pivotal connection 200 between arm 196 and link 198 where the continued forward movement of the roller 212 against roller 252 causes the pivotal connection 200 to move upwardly, as viewed in FIG. 16 while arm 196 continues to pivot about the pivotal connection 200. As the pivotal connection 200 is raised, the link 198 rotates counter-clockwise about pivot pin 202.

As both rollers 212 and 252 move forwardly, the splice of tape 44 to tape 42 is lengthened. In the meantime, the gripper 266 of the arm 246 abuts the tab 348 on the wall of bracket 288 and causes the gripper element 266 to be rotated away from tape 44 and roller 252 so as not to impede travel of the tape 44 around roller 252. At this time, it is noted that tape 42 is still intact and that tapes 42 and 44 are concurrently being stripped from the first and second rolls 38 and 40, respectively. The engagement of the tab 264 with the engagement surface 324 of the latch 282 prevents the cutting edge 260 of the blade 188 from contacting and cutting the tape 44. Solenoid 230 is still in its energized state with link 232 retracted and the release latch 234 pivoted.

Figure 17:
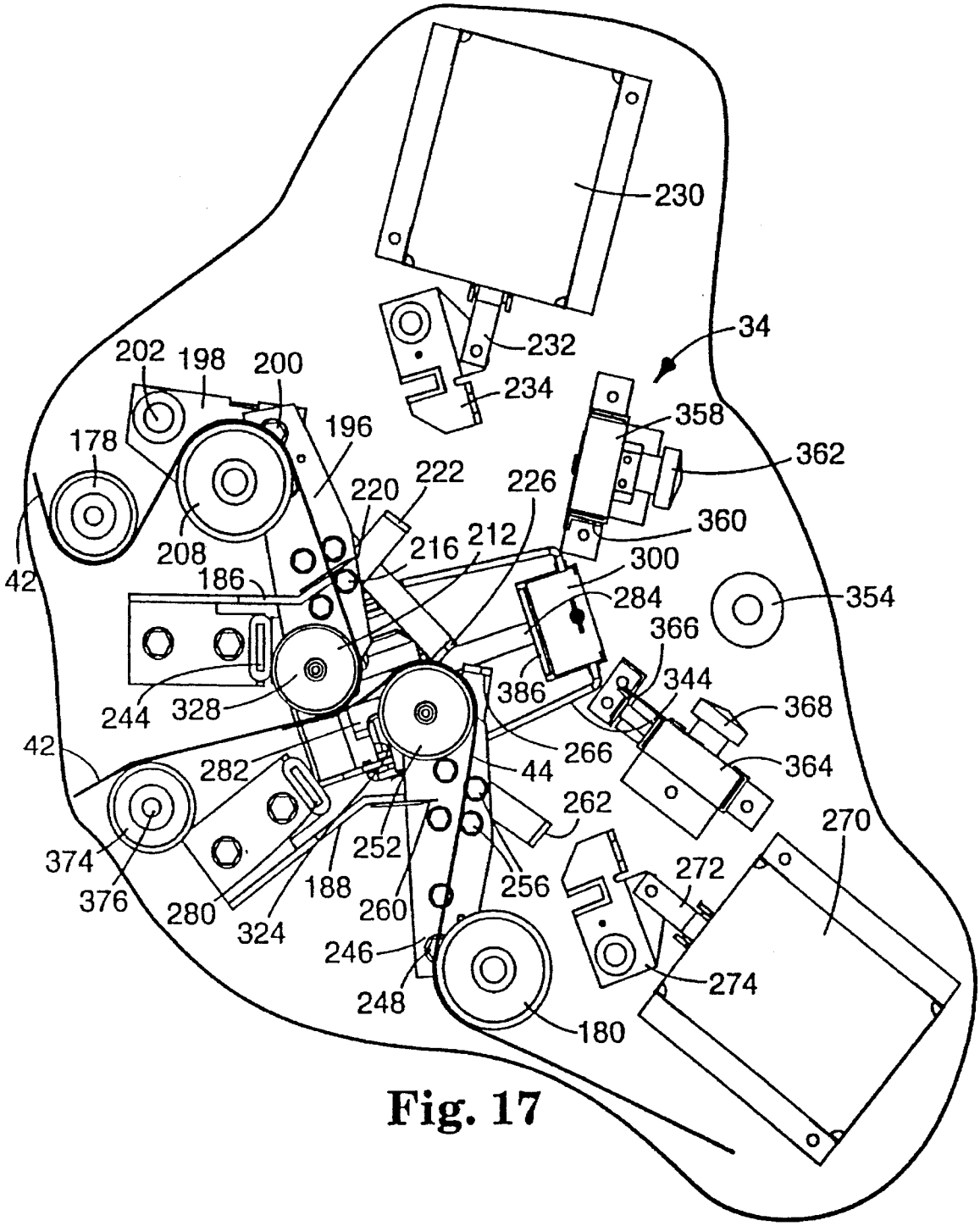

Referring now to FIG. 17, the continued demand of tape 42, albeit concurrently with the demand of tape 44, moves roller 212 even farther forward until the cutting edge 220 of the blade 186 cuts tape 42. It is noted that the roller 212 is movable forwardly until the edge of arm 196 engages with stop element 244 on the blade 186 because latch 282 is in its pivoted position such that the first latch portion 312 lies below the plane of movement of the lower edge tab 224, see FIG. 10. Also during this forward movement of the roller 212, the gripper element 226 of the arm 196 engages the tab 348 provided on the bracket 288 and the gripper element 226 is kept from interfering with tapes 42 or 44. Once the roller 212 leaves contact with the roller 252 of the arm 246, the arm 246 can move back against the engagement edge 326 of the latch 282 under the influence of the torsion spring 250 acting about pivot pin 248 if the tape tension is lower than the spring force. If not, the arm 246 will simply stay forward. Again, the splice is lengthened during this time, but continued demand for tape will only further strip the tape 44 from the second supply roll 40.

Figure 18:
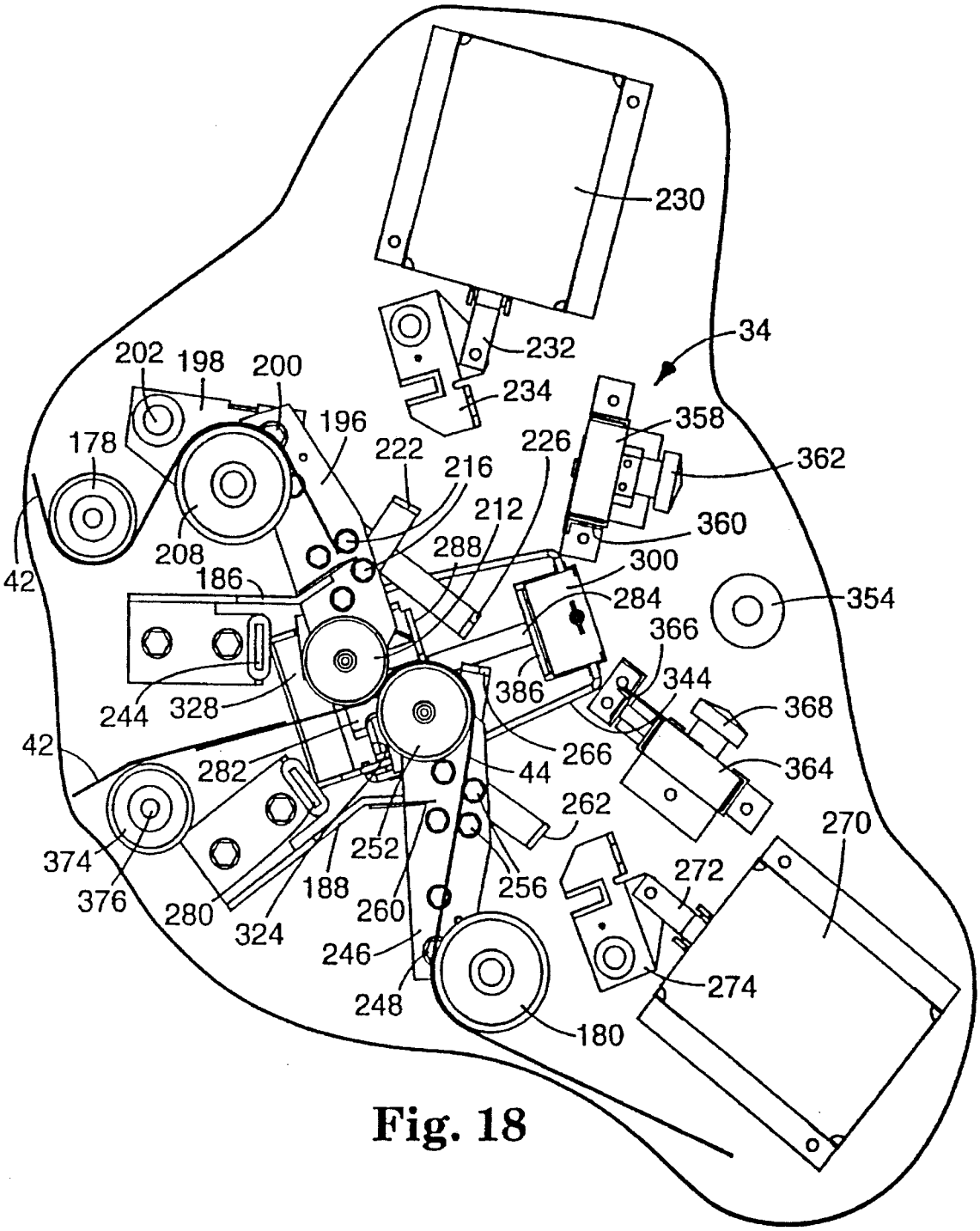

Referring now to FIG. 18, further demand of tape completes the splice to the trailing edge of the tape 42. Moreover, since the demand for tape 42 has ceased, the force pulling roller 212 forward has also stopped and the arm 196 is biased back under the influence of the torsion spring 238 about pivotal connection 200. At this point, the splice has been completed and the changeover from the first tape roll 38 to the second tape roll 40 has been effected. Continued demand for tape will only result in the stripping of the tape 44 from the tape roll 40 until such time as the supply of tape 44 is depleted and a next splice is initiated.

Figure 19:
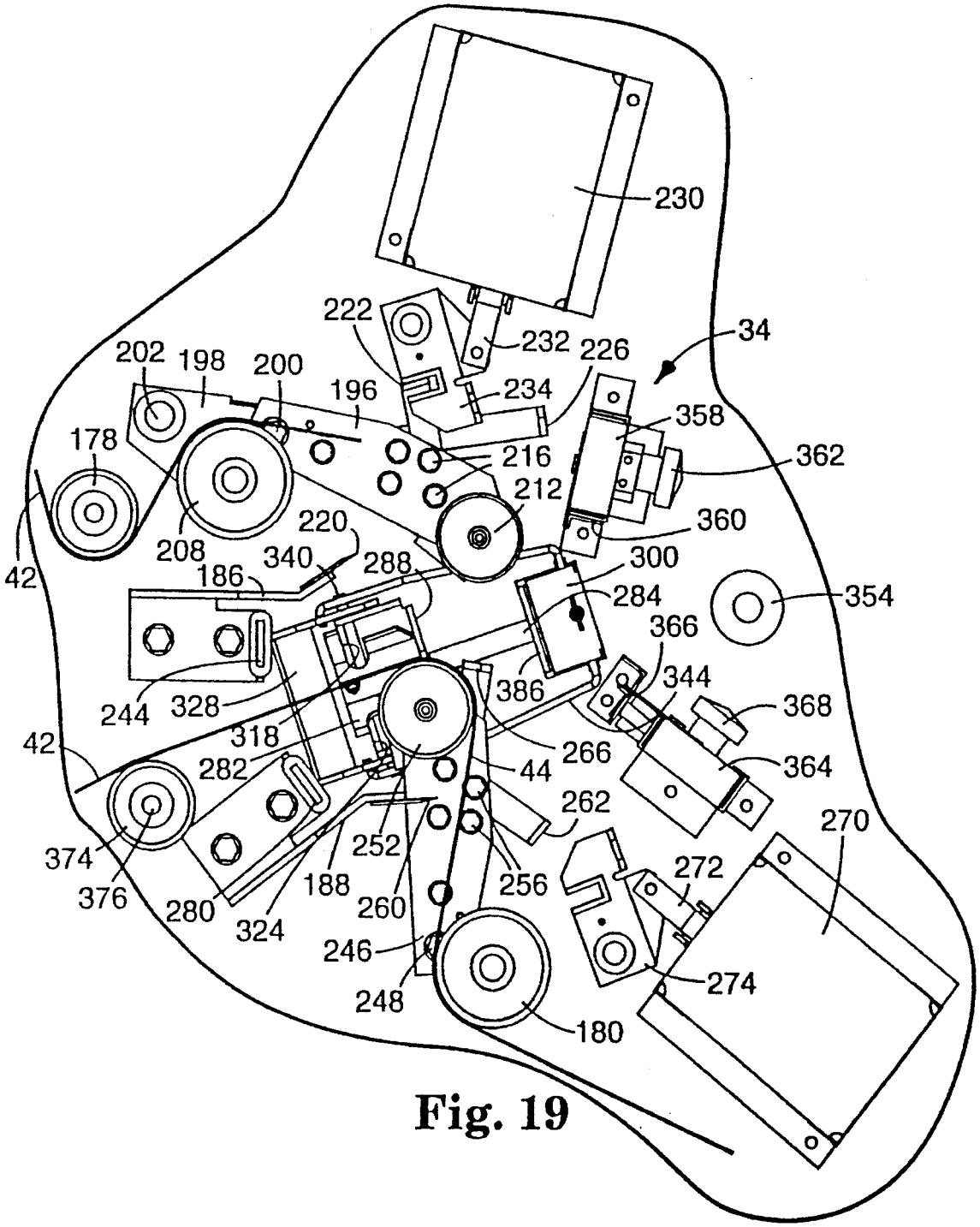

However, before a next splice can be made, a number of manual set up steps are required to both the arm 196 and the arm 246. Referring now to FIG. 19, the arm 196 is preferably first pivoted back to its latched position with the catch 222 captured within the release latch 234. For this to work, the solenoid 230 must be first deenergized and the link 232 thereof extended to position the release latch 234 in its capture position. This can be easily done by putting a new roll of tape on the first roll unwind station 30 or by otherwise disengaging the cam element 104 from the microswitch 107. In the mean time, tape 44 can be dispensed as required while the arm 246 continues to be latched by the latch 282.

Figure 20:
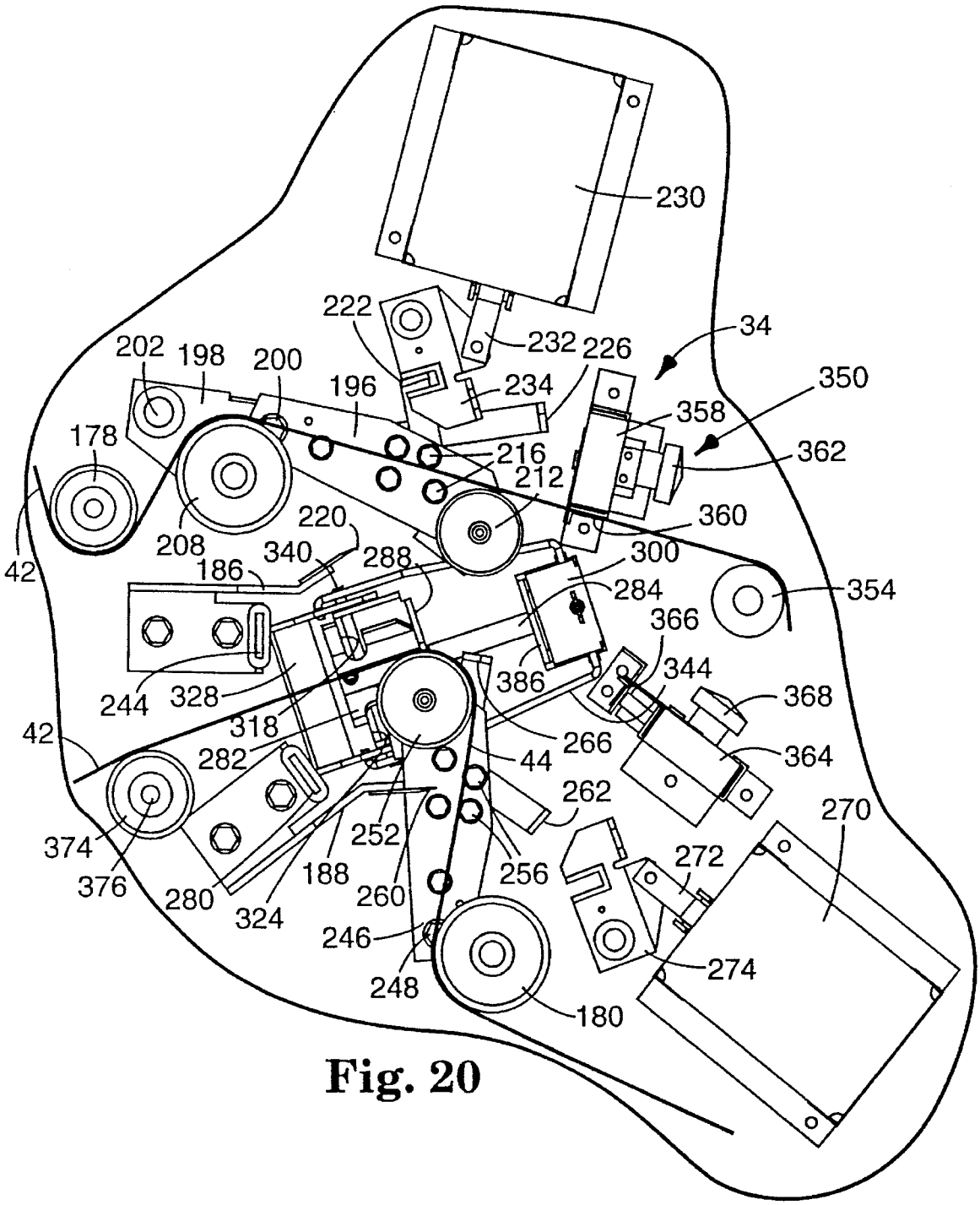
Figure 21:
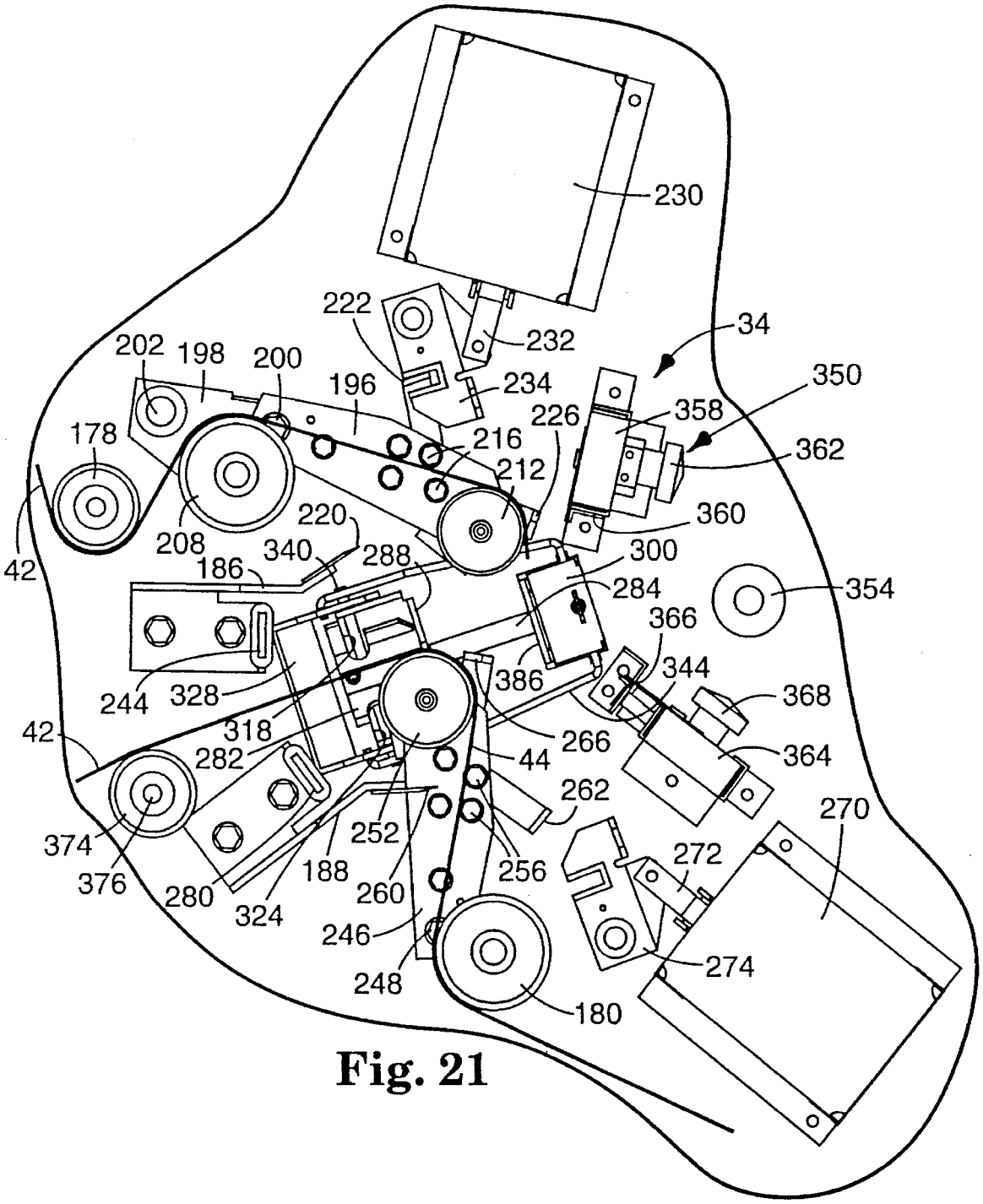

As shown in FIG. 20, new tape 42 is preferably next threaded to the splicing station 34. To do this, and to specifically control the leading edge of the tape 42 so it is ready for a next splice, the tape 42 is threaded over the roller 208, over roller 212, and then over the roller 354. This positions the tape 42 adjacent to the first cutting station 350. In this position, manual sliding of the blade 360 along the guide bracket 358 cuts and provides a leading edge of the tape 42 which will be appropriately positioned on the roller 212 to be ready for the next splice. The cut portion of tape 42 can be discarded. As shown in FIG. 21, the gripper element 226 is preferably then moved to contact the adhesive side of the tape 42 and to hold the non-adhesive side thereof against the roller 212 to maintain the leading edge of the tape 42 in a proper pick up position. Again, the arm 246 can be maintained in its latched state while tape 44 is continued to be demanded.

Figure 22:
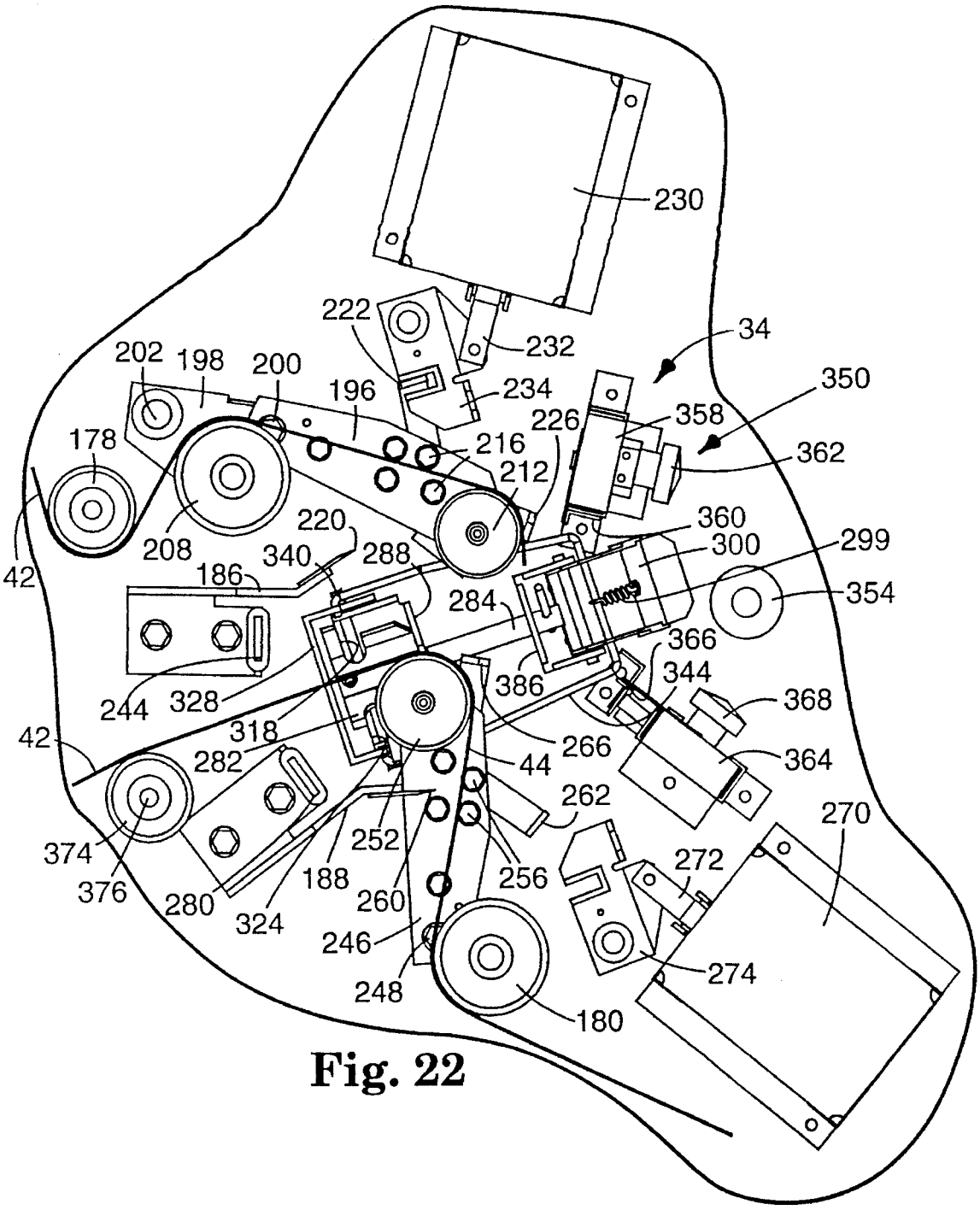

The next set up step to prepare for the next splice is to switch the latch 282 so that it will be engageable with the tab 224 of the arm 196 and will not engage with the tab 264 of the arm 246. As shown in FIG. 22, the first step of the latching process is to open the door 300 by pivoting it about its pivot shaft 302. As shown in FIG. 23, the door 300 is maintained in its open position by virtue of the over-center action of the spring 299 and wire element 344 within slots 346. The opening of the door 300 also raises the disabler member 328 into its disabling position where its engagement edges 342 are positioned to prevent forward travel of either arm 196 or 246 by engagement with the tab 224 or 264. In FIG. 22, the engagement edge 342 is shown engaged with the tab 264 to prevent forward travel of roller 252. This overrides the latch 282 in that it now permits the latch 282 to be moved to its other rotated position without affecting the arm 246.

Figure 25:
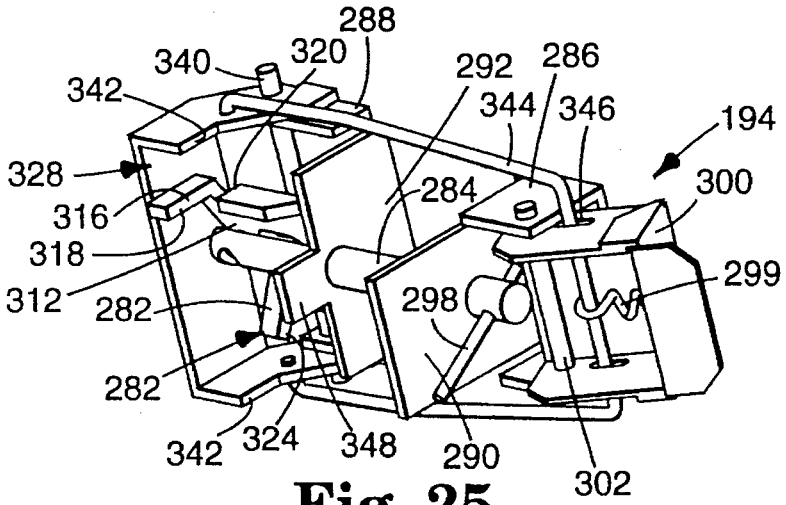
Figure 29:
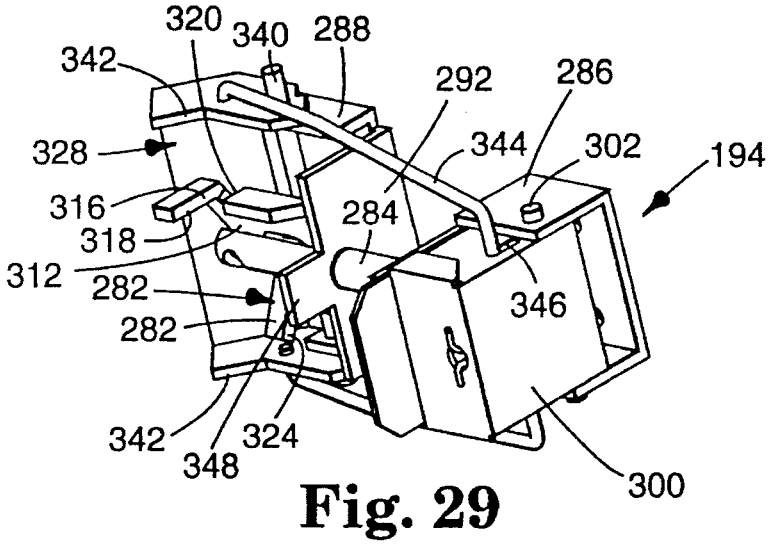
Figure 24:
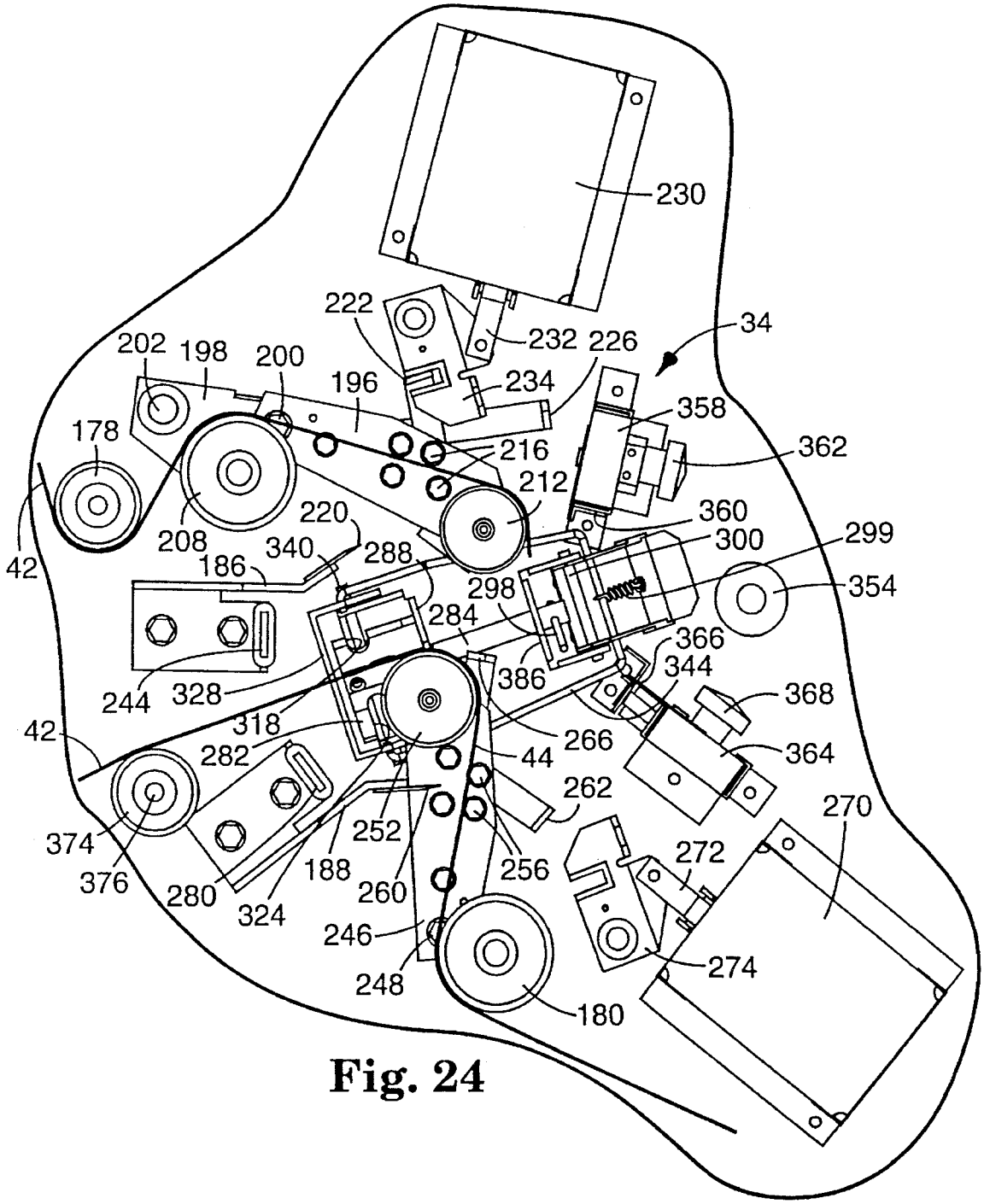

FIG. 24 illustrates the next step wherein the actuation element 298 is manipulated to rotate the shaft 284 and thus change the position of latch 282 such that the first latch portion 312 is now raised to an engagement position while the second latch portion 314 is lowered out of its engagement position, see FIG. 25. Again, because of the disabler member 328, the arm 246 is maintained in its position.

Figure 26:
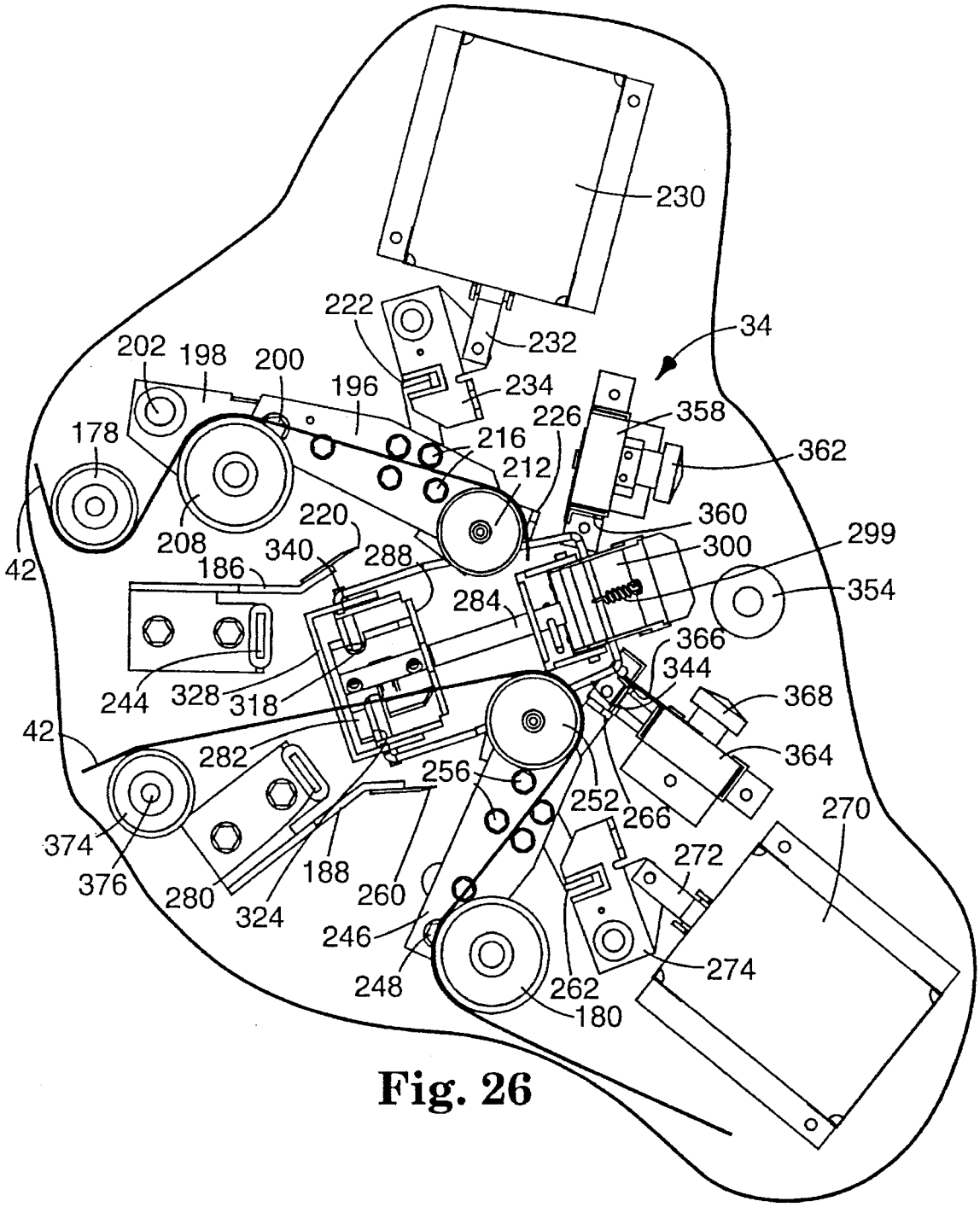

Preferably, the next step in preparing for the next splice, see FIG. 26, is the manual pivoting of the arm 246 about pivot pin 248 and the latching of the catch 262 by the release latch 274 for holding the arm 246 and thus roller 252 in its rearwardmost position. The release latch 274 is in its capture position because the link 272 would be extended since the second solenoid 270 would not be energized. Since the solenoid 270 is not energized, its link 272 can be manually retracted to pivot the release latch 274 and to capture the catch 262. The torsion spring under the release latch 274 biases the link 272 to its extended position. The arm 246 and roller 252 are now in their running positions in which positions the majority of the tape 44 will be demanded and dispensed from the second tape roll 40.

Figure 27:
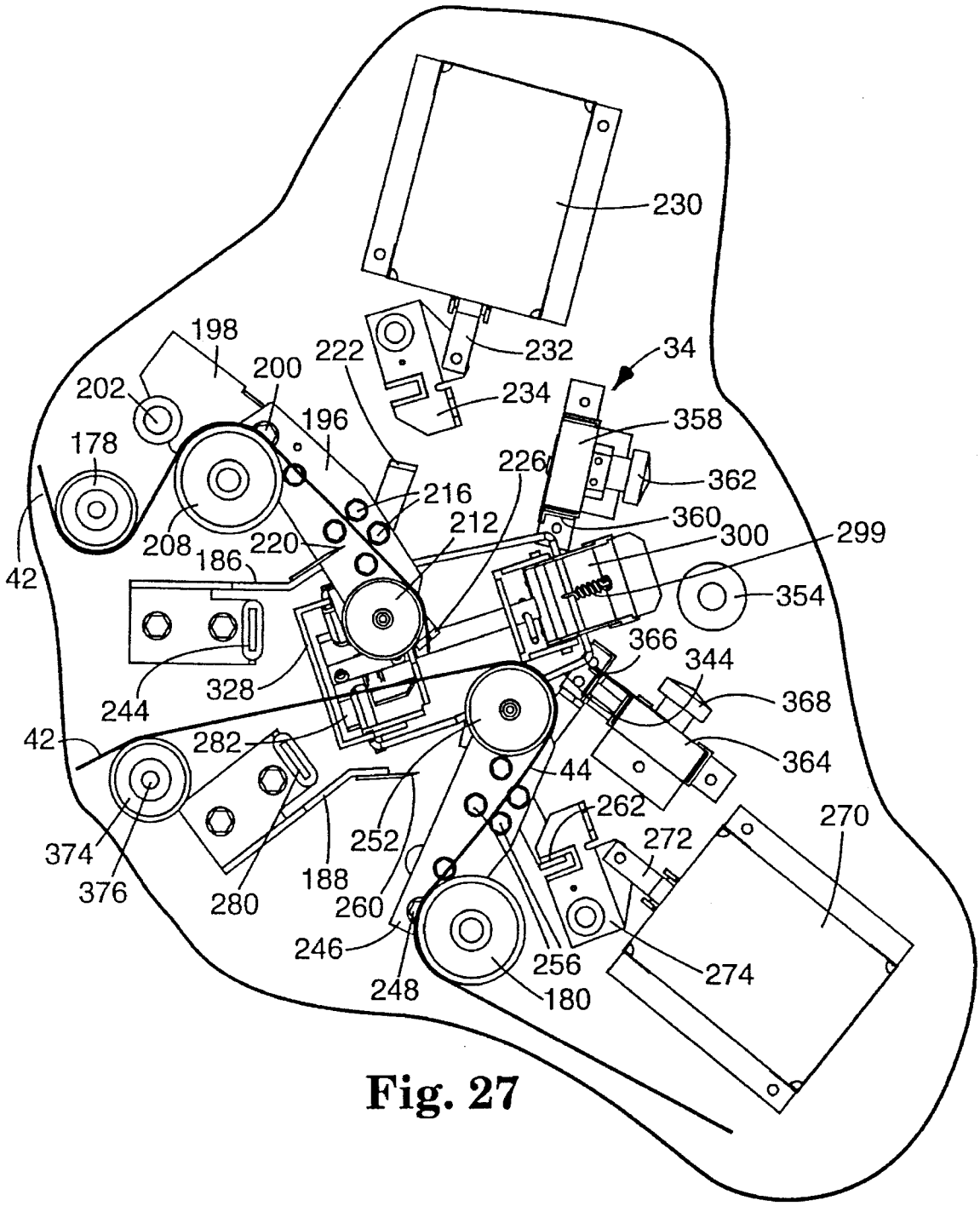
Figure 28:
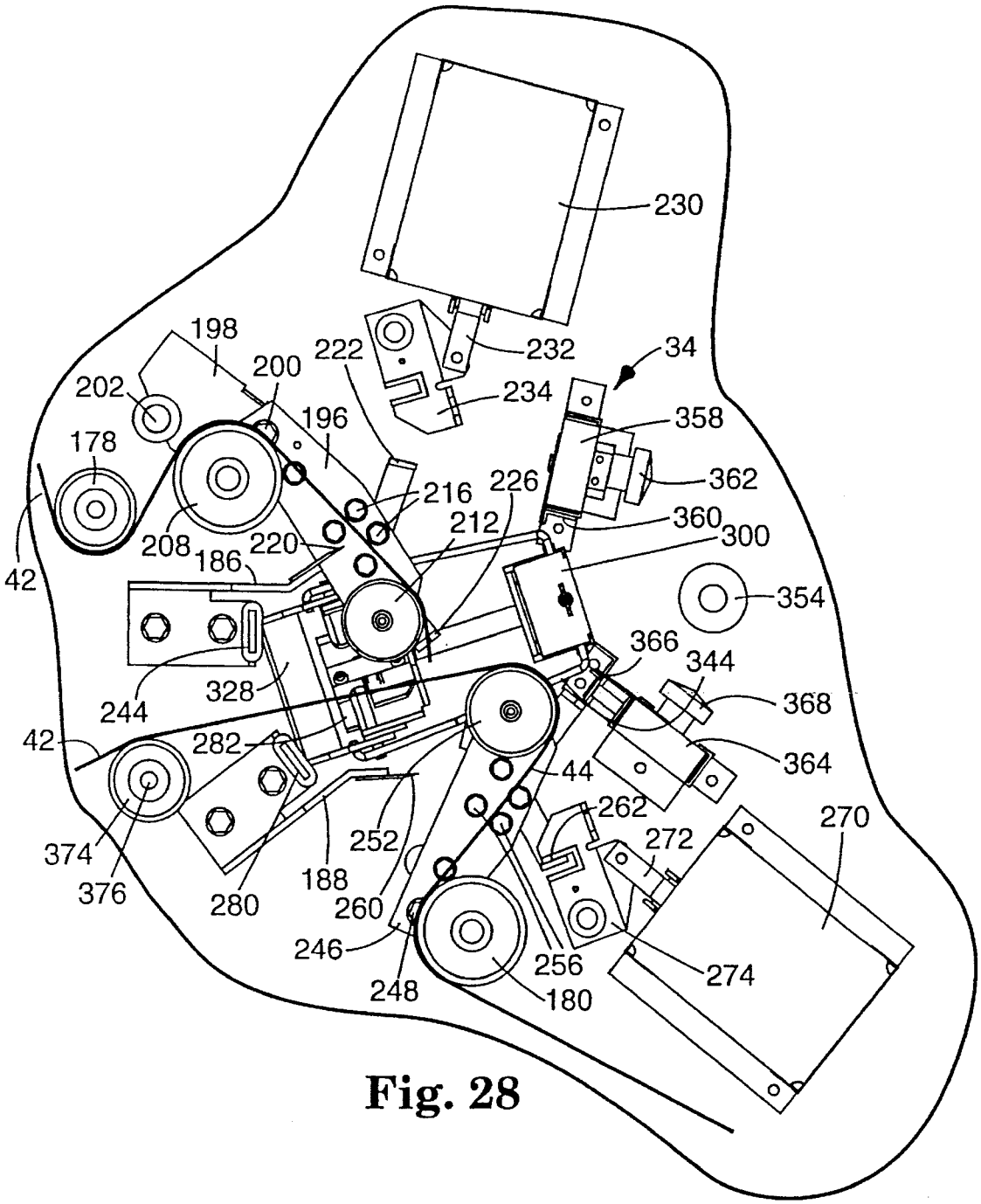

Next, as shown in FIG. 27, the arm 196 and roller 212 are positioned in a ready splice position by manually pivoting the release latch 234 to release the catch 222 and forcing the arm 196 to move about the pivot pin 200 against the bias of the torsion spring 238. The tab 224 of the arm 196 is positioned within the slot 316 of the first latch portion 312 of the latch 282. In order to do this, the tab 224 must be forced over the shorter section which defines the shorter engagement edge 320 of the first latch portion 312 of latch 282. The inherent flexibility of the arm 196, its connection point 200 and the latch 282 permit such movement with a relatively minimal force. The torsion springs 238 and 240, however, then urge the tab 224 to be engaged with the shorter engagement edge 320 once the tab 224 is within the slot 316. It is noted that at this point it is also preferable that the door 300 be maintained open so that the disabler member 328 is located in its disabling position to limit forward pivotal movement of the arm 196. Thereafter, as shown in FIG. 28, the door 300 is preferably closed, the disabler member 328 is moved to its nonuse position, and the splicing station 34 is now ready for the next splice changing from tape 44 to tape 42.

Upon depletion of the tape 44 from the second tape roll 40, the solenoid 270 will be activated by the engagement of cam element of stripper arm 148 with the microswitch 163, which will in turn retract the link 272 and pivot the release latch 274 about its pin 276 to release the catch 262 of the arm 246. Then, in the same manner as that described above with the movement of the arm 196, the arm 246 will be pulled forwardly by the continued demand of tape 44 until the splice begins when the tape 44 on roller 252 abuts the leading edge of the tape 42 located just adjacent to the roller 212. Again, since the adhesive surface of the tape 42 faces the non-adhesive surface of the tape 44 on the roller 252, the splice will be effected. Thereafter, the roller 252 will be moved forwardly as the splice is continued and while tape 44 is demanded up until the tape 44 is cut by the cutting edge 260 of the second blade 188. During this movement, the arm 196 will be moved forwardly and then returned rearwardly in the same manner as described above as influenced by the action of the roller 252. After the tape 44 is cut, and the splice is completed, tape 42 will thereafter be dispensed only from the first roll 38. A new roll of tape will be then provided on the second unwind station 32 and the splicing station 34 will be reconfigured as shown in FIG. 14 using preferably the same steps set out above in FIGS. 19–28. Of course, the latch 282 would be switched back so that the second latch portion 314 would assume its position for engagement with tab 264 of arm 246. Moreover, during the set up operation, the second cutting station 352 would be utilized for preparing the leading edge of the tape 44 to its splicing ready position on roller 252 as held in place by the gripper element 266.

It is understood that the above description is of a preferred embodiment of a continuous tape supply station which utilizes a splicing technique. Moreover, the manner of effecting the splice can be modified in many ways. Additionally, many other means are contemplated for activating and controlling the splicing operation instead of the use of microswitches and solenoids. For example, a mechanical connection could be provided between a limit switch which determines when the tape runs out and a release latch for releasing either of the first and second lever mechanisms 182 and 184. Alternatively, a sensor could be provided adjacent to the tape rolls 38 and 40 which senses a specific condition of the tape. That is, it may sense a decrease in tension once the tape 42 or 44 is pulled entirely from its core, or may sense a mark or pattern provided on the tape itself or on the core. Again, such sensors could be mechanically, electrically or otherwise connected to operate the release latches.

Furthermore, it is contemplated that additional control systems could be incorporated within the subject continuous tape supply station for minimizing or eliminating the operator manipulations described above. Such control means may include electrical systems, pneumatic or hydraulic systems, combinations thereof, or the like.

We claim:

1. A tape applicator machine having an indexing demand cycle for tape and a continuous tape supply apparatus for supplying adhesive tape to said tape applicator machine in accordance with a tension profile of the applicator machine characterized by a fluctuating tension within the adhesive tape during its demand cycle including intermittent rest periods between periods of demand, said continuous tape supply apparatus comprising:

a) a support;

b) a first tape source station provided on said support for receiving a first tape supply source and from which tape of the tape supply source can be dispensed;

c) a second tape source station provided on said support for receiving a second tape supply source and from which tape of the tape supply source can be dispensed;

d) guide means for guiding tape from said first and second tape source stations to be selectively supplied from the continuous tape supply apparatus to said tape applicator machine;

e) a splicing station provided on said support and along said guide means for splicing tape from said second tape source station to tape from said first tape source station so as to change the supply of tape from the first tape supply source to the second tape supply source;

f) control means for causing the splicing station to change the supply of tape from the first tape supply source to the second tape supply source upon the occurrence of a determined event; and tension control means for providing the tape from the continuous tape supply apparatus to said tape applicator machine at a substantially even tension over a demand cycle of said tape applicator machine under the indexing demand for tape from said tape applicator machine.

2. The apparatus of claim 1, wherein said splicing station comprises a splicing mechanism that splices the tape from the second tape supply source to the tape from the first tape supply source while the tape from the first tape supply source is moving.

3. The apparatus of claim 1, wherein the splicing mechanism also splices tape from the first tape supply source to tape from the second tape supply source so as to change the supply of tape from the second tape supply source to the first tape supply source under the control of the control means.

4. The apparatus of claim 1, wherein the tension control means comprises a variable loop forming means within the guide means for providing a capacity of tape within the path of the tape from the first tape supply source.

5. The apparatus of claim 4, wherein said variable loop forming means is operatively provided between said first tape source station and said splicing station.

6. The apparatus of claim 5, wherein said first tape source station comprises an unwind stand for supporting tape in roll form, said unwind stand including a rotatable hub and a brake mechanism for stopping rotation of said hub, and said variable loop forming means comprises a dancer arm pivotally mounted to said support including a means thereon for controlling the application of the brake against said hub depending on tape demand.

7. The apparatus of claim 6, wherein said splicing station comprises a splicing mechanism that splices the tape from the second tape supply source to the tape from the first tape supply source while the tape from the first tape supply source is moving.

8. The apparatus of claim 4, wherein said variable loop forming means is operatively provided after said splicing station.

9. The apparatus of claim 1, wherein said tension control means includes a tape drive station, a means for determining tape tension and a means for controlling the tape drive station in accordance with the means for determining tape tension.

10. The apparatus of claim 9, wherein the tension control means further comprises a variable loop forming means within the guide means for providing a capacity of tape from the first tape supply source.

11. The apparatus of claim 10, wherein said variable loop forming means is operatively provided between said first tape source station and said splicing station.

12. The apparatus of claim 11, further including a second variable loop forming means provided after said splicing station, and wherein said second variable loop forming means comprises a dancer arm pivoted to said support and said dancer arm along with a dancer arm position sensor together provide said means for determining tape tension.

13. The apparatus of claim 12, wherein said dancer arm position sensor comprises a force sensing device that changes its electrical resistance in response to force applied to it and which converts such change in resistance to a control voltage that is indicative of the position of the dancer arm and thus tape tension and which is further provided to a motor controller of the tape drive station.

14. The apparatus of claim 13, wherein said means for controlling the speed that the tape is driven through the tape drive station comprises a drive motor mounted to said support and a drive roller operatively connected to said motor, and said motor controller determines the speed that said motor is driven in accordance with the control voltage supplied to it from said dancer arm position sensor.

15. The continuous tape apparatus of claim 1, wherein said first and second tape source stations comprise unwind stands for supporting tape in roll form on the continuous tape apparatus, and further wherein said splicing control means comprises a limit switch for sensing when a roll of tape provided on at least one of said unwind stands is sufficiently depleted such that a changeover to another roll of tape is desired.

* * * * *